US011950634B2

(12) United States Patent
Bilat et al.

(10) Patent No.: US 11,950,634 B2
(45) Date of Patent: Apr. 9, 2024

(54) CONTROL OF AEROSOL PRODUCTION IN AN AEROSOL-GENERATING SYSTEM

(71) Applicant: Philip Morris Products S.A., Neuchatel (CH)

(72) Inventors: Stephane Bilat, Areuse (CH); Guillaume Colotte, Lausanne (CH); Daryl Ng Wai Leong, Singapore (SG); Ho Keat Chang, Johor Bahru (MY)

(73) Assignee: Philip Morris Products S.A., Neuchatel (CH)

( * ) Notice: Subject to any disclaimer, the term of this patent is extended or adjusted under 35 U.S.C. 154(b) by 759 days.

(21) Appl. No.: 17/252,928

(22) PCT Filed: Jun. 19, 2019

(86) PCT No.: PCT/EP2019/066287
§ 371 (c)(1),
(2) Date: Dec. 16, 2020

(87) PCT Pub. No.: WO2019/243464
PCT Pub. Date: Dec. 26, 2019

(65) Prior Publication Data

US 2021/0145070 A1 May 20, 2021

(30) Foreign Application Priority Data

Jun. 21, 2018 (EP) ..... 18179163

(51) Int. Cl.
*A24F 40/50* (2020.01)
*A24F 40/51* (2020.01)
(Continued)

(52) U.S. Cl.
CPC ..... *A24F 40/50* (2020.01); *A24F 40/51* (2020.01); *A24F 40/53* (2020.01); *A24F 40/10* (2020.01)

(58) Field of Classification Search
CPC ..... A24F 40/50; A24F 40/51; A24F 40/53; A24F 40/10; A24F 40/485; H02J 7/0063; H02J 7/00712; A61M 11/001
See application file for complete search history.

(56) References Cited

U.S. PATENT DOCUMENTS 10,123,570 B1 11/2018 Liu
10,159,279 B2 * 12/2018 Lord ..... G06F 1/3296
(Continued)

FOREIGN PATENT DOCUMENTS

CN 103237468 A 8/2013
CN 103945716 A 7/2014
(Continued)

OTHER PUBLICATIONS

Extended European Search Repon dated Dec. 18, 2018 in European Patent Application No. 18179163.3, 8 pages.
(Continued)

*Primary Examiner* — Shawntina T Fuqua
(74) *Attorney, Agent, or Firm* — Oblon, McClelland, Maier & Neustadt, L.L.P.

(57) ABSTRACT

A method of controlling aerosol production in an aerosol-generating system is provided, the system including an aerosol-generating element and a housing having an air inlet and an air outlet, a flow channel defined from the air inlet to the air outlet configured to provide a flow of air past the aerosol-generating element, and a flow sensor configured to detect an air flow in the flow channel; and the method including increasing a power supplied to the aerosol-generating element for at least a second time if the flow sensor detects that the flow rate of the air flow increases past a threshold. There is also provided an aerosol-generating system comprising circuitry configured to perform the method.

14 Claims, 8 Drawing Sheets

(51) Int. Cl.
*A24F 40/53* (2020.01)
*A24F 40/10* (2020.01)

(56) References Cited

U.S. PATENT DOCUMENTS

| | | | | |
|---|---|---|---|---|
| 11,179,527 | B2 * | 11/2021 | Bilat | A24F 40/51 |
| 2004/0129793 | A1 * | 7/2004 | Nguyen | B05B 17/04 239/128 |
| 2013/0340750 | A1 | 12/2013 | Thorens et al. | |
| 2015/0313284 | A1 | 11/2015 | Liu | |
| 2017/0135401 | A1 | 5/2017 | Dickens | |
| 2017/0135406 | A1 | 5/2017 | Reevell | |
| 2017/0360094 | A1 | 12/2017 | Kuczaj | |
| 2018/0042306 | A1 | 2/2018 | Atkins et al. | |
| 2018/0116292 | A1 | 5/2018 | Atkins et al. | |
| 2019/0029325 | A1 | 1/2019 | Liu | |
| 2019/0216137 | A1 | 7/2019 | Liu | |

FOREIGN PATENT DOCUMENTS

| | | | |
|---|---|---|---|
| JP | 2013-545474 | A | 12/2013 |
| JP | 2014-534814 | A | 12/2014 |
| RU | 2 605 837 | C2 | 12/2016 |
| RU | 2 621 596 | C2 | 6/2017 |
| WO | WO 2012/072790 | A1 | 6/2012 |
| WO | WO 2013/060784 | A2 | 5/2013 |

OTHER PUBLICATIONS

International Search Report and Written Opinion dated Oct. 7, 2019 in PCT/EP2019/066287 filed on Jun. 19, 2019.

Offce Action dated Apr. 13, 2023 in the corresponding Japanese Patent Application No. 2020-568738 (with English Translation), 6 pages.

Combined Russian Office Action and Search Report dated Sep. 21, 2022 in Russian Patent Application No. 2020142094 (with Engiish translation), 13 pages.

Chinese Office Action dated Oct. 27, 2023 issued in Chinese Patent Application No. 201980036080.7 filed on Jun. 19, 2019, with English Translation, total 15 pages.

* cited by examiner

CONTROL OF AEROSOL PRODUCTION IN AN AEROSOL-GENERATING SYSTEM

The invention relates to a method for controlling aerosol production in an aerosol-generating system. The invention further relates to an aerosol-generating system. The invention finds particular application as a method for controlling aerosol production in an aerosol-generating system through control of the power provided to an aerosol-generating element of the aerosol-generating system.

WO 2012/072790 discloses a method of controlling at least one electric heating element of an electrically heated aerosol-generating system for heating an aerosol-forming substrate. The aerosol-generating system has a sensor for detecting air flow indicative of a user taking a puff having an air flow duration. The method comprises the steps of increasing the heating power for the at least one heating element when the sensor detects that the air flow rate has increased to a first threshold, and decreasing the heating power for the at least one heating element when the sensor detects that the air flow rate has decreased to a second threshold.

As disclosed in WO 2012/072790, by controlling the heating power supplied to the at least one heating element, energy usage can be optimised. The heating power can be tailored to a particular puff profile so that desired aerosol properties, such as a particular aerosol concentration or particle size, can be achieved. Unnecessary overheating or underheating can also be avoided, particularly towards the start or end of the puff. The decrease of power towards the end of the puff affects the cooling of the heating element and, therefore, the temperature of the heating element and its vicinity. This, in turn, affects how much condensation is able to form in the system, which could affect liquid leakage.

The disclosure of WO 2012/072790 teaches a way to minimise condensation of aerosols generated by, and within, aerosol-generating devices by decreasing the heating power supplied to an aerosol-generating element before the end of a user puff. However, this can frustrate a user, particularly during a more complex puff profile, when an unsatisfactory aerosol is delivered to the user after the power supplied to the aerosol-generating element has been decreased.

It is an objective of the invention to provide an improved method of controlling aerosol production in an aerosol-generating system. In particular, it is an objective of the invention to provide an improved method of controlling aerosol production during a complex puff profile.

According to a first aspect of the invention, there is provided a method of controlling aerosol production in an aerosol-generating system. The system comprises an aerosol-generating element and a housing having an air inlet and an air outlet. A flow channel is defined through the housing from the air inlet to the air outlet and the flow channel provides a flow of air past the aerosol-generating element when a user puffs on the system. The system further comprises a flow sensor configured to detect an air flow in the flow channel indicative of the user taking a puff. The method comprises the following chronological steps:

increasing a power supplied to the aerosol-generating element from a power P0 to at least a power P1 when the flow sensor detects that a flow rate of the air flow is greater than a first threshold;

decreasing the power supplied to the aerosol-generating element to a power P2, wherein the power P2 is less than the power P1, when the flow sensor detects that the flow rate of the air flow is less than a second threshold, the second threshold being, or being indicative of, a flow rate which is a predetermined first proportion of a first maximum flow rate sensed by the flow sensor; and increasing the power supplied to the aerosol-generating element if the flow sensor detects that the flow rate of the air flow is greater than a third threshold, the third threshold being greater than the second threshold, before detecting that the flow rate of the air flow is less than an end of puff threshold, the end of puff threshold being less than the second threshold.

The steps of the method are presented in a chronological order. That is, the order of the steps as described above is the order in which the steps are performed. However, there may be more steps which are performed before, after, or between any of the steps of the method described above.

As used herein, the term "aerosol-generating system" may be used to describe a system configured to generate an aerosol. The aerosol may be for inhalation by a user. An aerosol-generating system may comprise an aerosol-generating device and a cartridge. The aerosol-generating device may comprise a power source. The cartridge may comprise an aerosol-forming substrate.

As used herein, the term "aerosol-generating element" may be used to describe one or more elements configured to generate an aerosol or vapour from an aerosol-forming substrate. The aerosol-generating element, or one or more of the elements forming the aerosol-generating element, may be connected to a power supply. That is, the aerosol-generating system may comprise a power supply configured to supply power to the aerosol-generating element.

As used herein, the term "aerosol-forming substrate" is used to mean a substrate capable of releasing volatile compounds that can form an aerosol. The volatile compounds may be released by heating the aerosol-forming substrate. The aerosols generated from aerosol-forming substrates of aerosol-generating systems according to the invention may be visible or invisible and may include vapours (for example, fine particles of substances, which are in a gaseous state, that are ordinarily liquid or solid at room temperature) as well as gases and liquid droplets of condensed vapours.

As used herein, the term "flow rate" may be used to describe any parameter indicative of a flow rate through an aerosol-generating system. For example, the defined "flow rate" may be one or more of a pressure, a flow speed, a temperature, a mass flow rate or a volume flow rate. As such, the defined "flow sensor" may detect one or more of a pressure, a flow speed, a temperature, a mass flow rate or a volume flow rate.

As used herein, the term "puff detection system" may refer to a system comprising a flow sensor.

As used herein, the term "air flow" may be used to refer to a flow of only air, or may be used to refer to a flow of air combined with aerosol droplets.

As used herein, the term "droplets" may be used to mean droplets or particles. That is, the term "droplets" may refer to liquid droplets. Alternatively, or in addition, the term "droplets" may refer to solid particles.

The flow sensor may comprise an electro-mechanical device, or a mechanical device, or an optical device, or an opto-mechanical device, or a micro electro mechanical systems (MEMS) based sensor, or an acoustic sensor, or any combination of the foregoing.

As used herein, "a puff" is used to describe an inhalation by a user which causes a flow of air through the aerosol-generating system. The starting point of a puff is defined by the point where the flow sensor detects that the flow rate is greater than a puff start threshold and the ending point of the puff is defined by the point where the flow sensor detects that the flow rate has decreased to less than the end of puff threshold.

As used herein, the term "predetermined" is used to mean determined prior to the starting point of a puff.

According to the first aspect of the invention, the method of controlling aerosol production comprises the step of increasing the power supplied to the aerosol-generating element if the flow sensor detects that the flow rate of the air flow is greater than a third threshold before detecting that the flow rate of the air flow is less than an end of puff threshold. That is, the power supplied to the aerosol-generating element may be increased more than once during the puff, depending on the puff profile. This advantageously allows the aerosol-generating system to deliver satisfactory aerosol to the user during a puff with a complex puff profile. In this context, the term "complex puff profile" is used to mean a puff profile having at least one local minimum when a graph of flow rate against time is plotted. For example, this step may mitigate a potential problem with an exemplary puff profile which includes the following stages:

Stage 1: The user puffs on the system, causing the detected flow rate of the air flow to increase from zero a first maximum flow rate.

Stage 2: The detected flow rate then decreases to a first local minimum flow rate which is greater than the end of puff threshold.

Stage 3: The flow rate then increases to a second maximum flow rate.

Stage 4: The flow rate then decreases to below the end of puff threshold, indicating that the puff has finished.

If the power supplied to the aerosol-generating element were reduced between Stage 2 and Stage 3 of the puff and never increased again, the user could be frustrated by the delivery of an inadequate aerosol during Stage 3 and Stage 4 of the puff. With a method in accordance with the invention, the power supplied to the aerosol-generating element may be increased during Stage 3. Thus, the user may be delivered an adequate aerosol during Stage 3 and Stage 4.

The power P0 may be zero. Advantageously, this may save power. This may mean that the aerosol-generating system does not need to be recharged as frequently.

Alternatively, the power P0 may be a non-zero power. Advantageously, this may allow the system to deliver adequate aerosol more quickly in response to a detected puff.

The power P2 may be zero. Advantageously, this may save power. This may mean that the aerosol-generating system does not need to be recharged as frequently.

Alternatively, the power P2 may be a non-zero power. Advantageously, this may allow the system to deliver adequate aerosol more quickly in response to a detected flow rate greater than the third threshold.

The third threshold may be a predetermined second proportion of the first maximum flow rate. The predetermined second proportion must be greater than the predetermined first proportion so that the third threshold is greater than the second threshold.

Alternatively, the third threshold may be a predetermined multiple of the second threshold. The predetermined multiple must be greater than 1 so that the third threshold is greater than the second threshold. The predetermined multiple does not have to be an integer.

The first threshold may be a first constant.

The end of puff threshold may be an end of puff constant.

The step of increasing the power supplied to the aerosol-generating element from the power P0 to at least a power P1 may comprise increasing the power supplied to the aerosol-generating element to a power PX, PX being greater than, or equal to, the power P1. The step of increasing the power supplied to the aerosol-generating element if the flow sensor detects that the flow rate of the air flow is greater than a third threshold before detecting that the flow rate of the air flow is less than an end of puff threshold may comprise increasing the power supplied to the aerosol-generating element to a power P3, P3 being less than, or equal to, PX. P3 being less than PX may be advantageous for common puff profiles in which the first maximum flow rate is the largest flow rate during the puff.

The method may comprise, after the step of increasing the power supplied to the aerosol-generating element if the flow sensor detects that the flow rate of the air flow is greater than a third threshold before detecting that the flow rate of the air flow is less than an end of puff threshold, a step of decreasing the power supplied to the aerosol-generating element to a power P4 when the flow sensor detects that the flow rate of the air flow is less than the end of puff threshold.

The power P4 may be zero. Advantageously, this may save power. This may mean that the aerosol-generating system does not need to be recharged as frequently.

Alternatively, the power P4 may be non-zero. Advantageously, this may allow the system to deliver adequate aerosol more quickly in response to the next detected puff.

The power P4 may be non-zero, and the method may further comprise, after the step of decreasing the power supplied to the aerosol-generating element to a power P4 when the flow sensor detects that the flow rate of the air flow is less than the end of puff threshold, a step of decreasing the power supplied to the aerosol-generating element from the power P4 to zero. Decreasing the power supplied to the aerosol-generating element from the power P4 to zero may occur if another puff is not detected within a given time interval, for example, within 5 minutes, or within 3 minutes, after the power supplied to the aerosol-generating element is decreased to the power P4. That is, decreasing the power supplied to the aerosol-generating element from the power P4 to zero may occur if a flow rate greater than the first threshold is not detected within a given time interval after the power supplied to the aerosol-generating element is decreased to the power P4.

The step of increasing the power supplied to the aerosol-generating element from the power P0 to at least a power P1 may comprise increasing the power from the power P0 to at least the power P1 substantially instantly. That is, the power may be increased from the power P0 to at least the power P1 over a time period which is substantially equal to zero. On a plot of heating power on the vertical axis versus time on the horizontal axis, this would be represented by a vertical, or substantially vertical, line from the power P0 to at least the power P1. For example, the term "substantially instantly" may be used to mean that the power may be increased from the power P0 to at least the power P1 within 0.1 seconds. Advantageously, increasing a power supplied to the aerosol-generating element substantially instantly may result in quicker generation of aerosol and less lag for the user.

Alternatively, the step of increasing the power supplied to the aerosol-generating element from the power P0 to at least a power P1 may comprise increasing the power from the power P0 to at least the power P1 gradually. That is, the power may be increased from the power P0 to at least the power P1 gradually over a time period. The longer the time period, the more gradual the power increase. On a plot of heating power on the vertical axis versus time on the horizontal axis, this would be represented by a line with a positive average gradient from the power P0 to at least the power P1. The gradient of the line may be constant or non-constant. That is, the rate of change of power may be constant or may not be constant. For example, the term "gradually" may be used to mean that the power may be increased from the power P0 to at least the power P1 over a time period of between 0.1 seconds and 1 second, or between 0.2 seconds and 0.6 seconds, or between 0.2 seconds and 0.4 seconds.

The step of decreasing the power supplied to the aerosol-generating element to a power P2 may comprise decreasing the power supplied to the aerosol-generating element from at least the power P1 to the power P2.

The step of decreasing the power supplied to the aerosol-generating element to a power P2 may comprise decreasing the power supplied to the aerosol-generating element to the power P2 substantially instantly. That is, the power may be decreased to the power P2 over a time period which is substantially equal to zero. On a plot of heating power on the vertical axis versus time on the horizontal axis, this would be represented by a vertical, or substantially vertical, line to the power P2. For example, the term "substantially instantly" may be used to mean that the power may be increased to the power P2 within 0.1 seconds.

Alternatively, the step of decreasing the power supplied to the aerosol-generating element to a power P2 may comprise decreasing the power supplied to the aerosol-generating element to the power P2 gradually. That is, the power may be decreased over a time period not equal to zero. That is, the power may be decreased to the power P2 gradually over a time period. The longer the time period, the more gradual the power decrease. On a plot of heating power on the vertical axis versus time on the horizontal axis, this would be represented by a line with a negative average gradient to the power P2. The gradient of the line may be constant or non-constant. For example, the term "gradually" may be used to mean that the power may be decreased to the power P2 within a time period of between 0.1 seconds and 1 second, or between 0.2 seconds and 0.6 seconds, or between 0.2 seconds and 0.4 seconds, after the flow sensor detects that the flow rate of the air flow is less than a second threshold.

The method may comprise, after the step of increasing the power supplied to the aerosol-generating element from the power P0 to at least the power P1, but before the step of decreasing the power supplied to the aerosol-generating element to the power P2, a step of increasing the power supplied to the aerosol-generating element from at least the power P1 to a power P5.

The power supplied to the aerosol-generating element may be increased from at least the power P1 to the power P5 after, and preferably substantially instantly after, the step of increasing the power supplied to the aerosol-generating element from the power P0 to at least the power P1. In this context, the term "substantially instantly" may be used to mean within 0.1 seconds.

Alternatively, the step of increasing the power supplied to the aerosol-generating element from the power P0 to at least the power P1 may comprise increasing the power supplied to the aerosol-generating element from the power P0 to the power P5, where the power P5 is greater than the power P1.

Advantageously, this may provide a burst of electric power near the start of the puff. High power near the start of the puff may result in adequate aerosol generation beginning earlier. This may provide better reactivity for the user. This may also decrease aerosol droplet size near the start of the puff. The power P5 may be pre-defined. The power P5 may depend on a number of factors including, but not limited to, a form of the aerosol-generating element, a type of aerosol-forming substrate, an amount of aerosol desired to be formed, and a droplet size required for the aerosol. Preferably, after the initial burst of electric power, the power decreases, for example to the power P1.

Supplying power to the aerosol-generating element may comprise supplying pulses of electric current to the aerosol-generating element.

Increasing or decreasing the power supplied to the aerosol-generating element may comprise altering the frequency or magnitude or both frequency and magnitude of supplied pulses of electric current to the aerosol-generating element.

According to a second aspect of the invention, there is provided an aerosol-generating system. The system comprises an aerosol-generating element and a flow channel configured to allow an air flow past the aerosol-generating element. The system further comprises a flow sensor configured to detect the air flow, wherein the air flow is indicative of a user taking a puff, and a power supply for supplying power to the aerosol-generating element. The system further comprises electric circuitry for controlling supply of power from the power supply to the aerosol-generating element, the electric circuitry being arranged to perform a method according to the first aspect of the invention.

According to a third aspect of the invention, there is provided electric circuitry for an aerosol-generating system, the electric circuitry being arranged to perform a method according to the first aspect of the invention.

According to a fourth aspect of the invention, there is provided a computer program which, when run on programmable electric circuitry for an aerosol-generating system, causes the programmable electric circuitry to perform a method according to the first aspect of the invention.

According to a fifth aspect of the invention, there is provided a computer readable storage medium having stored thereon a computer program according to the fourth aspect of the invention.

According to a sixth aspect, there is provided a method of controlling aerosol production in an aerosol-generating system. The system comprises an aerosol-generating element and a housing having an air inlet and an air outlet. A flow channel is defined through the housing from the air inlet to the air outlet, and the flow channel provides a flow of air past the aerosol-generating element when a user puffs on the system. The system further comprises a flow sensor configured to detect the air flow, wherein the air flow is indicative of a user taking a puff. The method comprises a step of increasing a power supplied to the aerosol-generating element from a power p20 to at least a power p21 when the flow sensor detects that a flow rate of the air flow is greater than a first threshold t21. The method further comprises a step of decreasing the power supplied to the aerosol-generating element to a power p22, wherein the power p22 is less than the power p21, following the detection that the flow rate of the air flow is greater than the first threshold t21, upon occurrence of whichever of the following conditions occurs first:

- the flow sensor detects that the flow rate of the air flow is less than a second threshold t22, the second threshold t22 being, or being indicative of, a predetermined flow rate, or
- the flow sensor detects that the flow rate of the air flow is less than a third threshold t23, the third threshold t23 being, or being indicative of, a flow rate which is a predetermined proportion of a maximum detected flow rate of the air flow.

The second threshold t22 and the third threshold t23 are both greater than zero.

Advantageously, decreasing the power supplied to the aerosol-generating element before the flow rate falls to zero may reduce how much condensation is able to form in the system, which may affect liquid leakage.

Advantageously, by decreasing the power supplied to the aerosol-generating element upon occurrence of whichever condition occurs first, the power may be decreased at a greater flow rate for a puff with a larger maximum detected flow rate. But, regardless of the maximum detected flow rate of a puff, the second threshold t22 provides a minimum flow rate at which the power supplied to the aerosol-generating element is decreased.

The power p22 may be zero.

The step of increasing the power supplied to the aerosol-generating element from the power p20 to at least a power p21 may comprise increasing the power from the power p20 to at least the power p1 substantially instantly. That is, the power may be increased from the power p20 to at least the power p21 over a time period which is substantially equal to zero. On a plot of heating power on the vertical axis versus time on the horizontal axis, this would be represented by a vertical, or substantially vertical, line from the power p20 to at least the power p21. For example, the term "substantially instantly" may be used to mean that the power may be increased from the power p20 to at least the power p21 within 0.1 seconds.

Alternatively, according to the sixth aspect, the step of increasing the power supplied to the aerosol-generating element from the power p20 to at least a power p21 may comprise increasing the power from the power p20 to at least the power p21 gradually. That is, the power may be increased from the power p20 to at least the power p21 gradually over a time period. The longer the time period, the more gradual the power increase. On a plot of heating power on the vertical axis versus time on the horizontal axis, this would be represented by a line with a positive average gradient from the power p20 to at least the power p21. The gradient of the line may be constant or non-constant. For example, the term "gradually" may be used to mean that the power may be increased from the power p20 to at least the power p21 over a time period of between 0.1 seconds and 1 second, or between 0.2 seconds and 0.6 seconds, or between 0.2 seconds and 0.4 seconds.

According to the sixth aspect, the step of decreasing the power supplied to the aerosol-generating element to a power p22 may comprise decreasing the power supplied to the aerosol-generating element from at least the power p21 to the power p22.

According to the sixth aspect, the step of decreasing the power supplied to the aerosol-generating element to a power p22 may comprise decreasing the power supplied to the aerosol-generating element to the power p22 substantially instantly. That is, the power may be decreased to the power p22 over a time period which is substantially equal to zero. On a plot of heating power on the vertical axis versus time on the horizontal axis, this would be represented by a vertical, or substantially vertical, line from to the power p22. For example, the term "substantially instantly" may be used to mean that the power may be increased to the power p22 within 0.1 seconds.

Alternatively, according to the sixth aspect, the step of decreasing the power supplied to the aerosol-generating element to a power p22 may comprise decreasing the power supplied to the aerosol-generating element to the power p22 gradually. That is, the power may be decreased over a time period not equal to zero. That is, the power may be decreased to the power p22 gradually over a time period. The longer the time period, the more gradual the power decrease. On a plot of heating power on the vertical axis versus time on the horizontal axis, this would be represented by a line with a negative average gradient to the power p22. The gradient of the line may be constant or non-constant. For example, the term "gradually" may be used to mean that the power may be decreased to the power p22 within a time period of between 0.1 seconds and 1 second, or between 0.2 seconds and 0.6 seconds, or between 0.2 seconds and 0.4 seconds, after the flow sensor detects that the flow rate of the air flow is less than a second threshold t22.

According to the sixth aspect, the method may comprise, after the step of increasing the power supplied to the aerosol-generating element from the power p20 to at least the power p21, but before the step of decreasing the power supplied to the aerosol-generating element to the power p22, a step of increasing the power supplied to the aerosol-generating element from at least the power p21 to a power p25.

According to the sixth aspect, the power supplied to the aerosol-generating element may be increased from at least the power p21 to the power p25 after, and preferably substantially instantly after, the step of increasing the power supplied to the aerosol-generating element from the power p20 to at least the power p21. In this context, the term "substantially instantly" may be used to mean within 0.1 seconds.

Alternatively, the step of increasing the power supplied to the aerosol-generating element from the power p20 to at least the power p21 may comprise increasing the power supplied to the aerosol-generating element from the power p20 to the power p25, where the power p25 is greater than the power p21.

This may provide a burst of electric power near the start of the puff. Such a burst of power near the start of the puff may result in adequate aerosol generation beginning earlier. This may provide better reactivity for the user. This may also decrease aerosol droplet size near the start of the puff. The power p25 may be pre-defined. The power p25 may depend on a number of factors including, but not limited to, a form of the aerosol-generating element, a type of aerosol-forming substrate, an amount of aerosol desired to be formed, and a droplet size required for the aerosol. Preferably, after the initial burst of electric power, the power decreases, for example to the power p21.

According to the sixth aspect, supplying power to the aerosol-generating element may comprise supplying pulses of electric current to the aerosol-generating element.

According to a seventh aspect, there is provided an aerosol-generating system arranged to perform a method of the sixth aspect. The system comprises an aerosol-generating element and a flow channel configured to allow an air flow past the aerosol-generating element. The system further comprises a flow sensor configured to detect the air flow, wherein the air flow is indicative of a user taking a puff, and a power supply for supplying power to the aerosol-generating element. The system further comprises electric circuitry for controlling supply of power from the power supply to the aerosol-generating element, the electric circuitry being arranged to perform a method according to the sixth aspect.

According to an eighth aspect, there is provided electric circuitry for an aerosol-generating system, the electric circuitry being arranged to perform a method of the sixth aspect.

According to a ninth aspect, there is provided a computer program which, when run on programmable electric circuitry for an aerosol-generating system, causes the programmable electric circuitry to perform a method of the sixth aspect.

According to a tenth aspect, there is provided a computer readable storage medium having stored thereon a computer program which, when run on programmable electric circuitry for an aerosol-generating system, causes the programmable electric circuitry to perform a method of the sixth aspect.

According to an eleventh aspect, there is provided a method of controlling aerosol production in an aerosol-generating system. The system comprises an aerosol-generating element and a housing having an air inlet and an air outlet, a flow channel being defined through the housing from the air inlet to the air outlet, the flow channel providing a flow of air past the aerosol-generating element when a user puffs on the system. The system further comprises a flow sensor configured to detect the air flow, wherein the air flow is indicative of a user taking a puff. The method according to the eleventh aspect comprises the following chronological steps:

increasing a power supplied to the aerosol-generating element from a power p30 to at least a power p31 when the flow sensor detects that a flow rate of the air flow is greater than a first threshold t31;

decreasing the power supplied to the aerosol-generating element to a power p32, the power p32 being less than the power p31, when the flow sensor detects that the flow rate of the air flow is less than a second threshold t32; and either increasing the power supplied to the aerosol-generating element to a power p33 if, within a predetermined time interval after the flow sensor detected that the flow rate of the air flow was less than the second threshold t32, the flow sensor detects that the flow rate of the air flow is greater than a third threshold t33, the third threshold t33 being less than the second threshold t32, or increasing the power supplied to the aerosol-generating element to a power p34 if the flow sensor detects that the flow rate of the air flow is less than a fourth threshold t34, the fourth threshold t34 being less than the second threshold t32, and a time difference between detecting that the flow rate of the air flow is less than the second threshold t32 and detecting that the flow rate of the air flow is less than the fourth threshold t34 is greater than a fifth threshold t35.

According to the eleventh aspect, the third threshold t33 is less than the second threshold t32 and the fourth threshold t34 is less than the second threshold t32. Advantageously, this allows the aerosol-generating system to deliver satisfactory aerosol to the user during a slowly dying puff.

According to the eleventh aspect, the second threshold t32 may be, or may be indicative of, a flow rate which is a predetermined first proportion of a first maximum flow rate sensed by the flow sensor.

According to the eleventh aspect, the flow sensor may continuously or intermittently detect the flow rate.

According to the eleventh aspect, the flow sensor may detect a flow rate a first predetermined time period after the flow sensor has detected that the flow rate has decreased to less than a second threshold t32. The flow sensor may then compare this flow rate detected a first predetermined time period after the flow sensor has detected that the flow rate has decreased to less than a second threshold t32 with the third threshold t33.

According to the eleventh aspect, the flow sensor may regularly detect a flow rate throughout the puff, meaning that a flow rate is detected every time period tp3. The flow sensor may compare the $n^{th}$ flow rate detected after detecting that the flow rate has decreased to less than a second threshold t32 with the third threshold t33, where n is an integer greater than one. Advantageously, this means that the $n^{th}$ flow rate is not compared with the third threshold until a time period of at least n−1 multiplied by the time period tp3 has passed since the flow sensor first detected that the flow rate decreased to less than the second threshold.

According to the eleventh aspect, any increase or decrease of power supplied to the aerosol-generating element may occur substantially instantly or gradually. As explained in relation to the claimed invention, and in reference to the method of the sixth aspect, the term "gradually" may be used to mean within a time period of between 0.1 seconds and 1 second, or between 0.2 seconds and 0.6 seconds, or between 0.2 seconds and 0.4 seconds, and the term "substantially instantly" may be used to mean within 0.1 seconds.

According to the eleventh aspect, the power p32 may be zero. The power p33 may be a predetermined power. The power p34 may be a predetermined power. The power p33 and the power p34 may be the same power. Alternatively, the power p33 and the power p34 may be different powers.

The method according to the eleventh aspect may comprise, after the step of increasing the power supplied to the aerosol-generating element from the power p30 to at least the power p31, but before the step of decreasing the power supplied to the aerosol-generating element to the power p32, a step of increasing the power supplied to the aerosol-generating element from at least the power p31 to a power p35.

According to the eleventh aspect, the power supplied to the aerosol-generating element may be increased from at least the power p31 to power p35 after, and preferably substantially instantly after, the step of increasing the power supplied to the aerosol-generating element from the power p30 to at least the power p31. In this context, the term "substantially instantly" may be used to mean within 0.1 seconds.

Alternatively, according to the eleventh aspect, the step of increasing the power supplied to the aerosol-generating element from the power p30 to at least the power p31 may comprise increasing the power supplied to the aerosol-generating element from the power p30 to the power p35, where p35 is greater than p31.

This may provide a burst of electric power near the start of the puff. Such a burst of power near the start of the puff may result in adequate aerosol generation beginning earlier. This may reduce lag for the user. This may also decrease aerosol droplet size near the start of the puff. The power p35 may be pre-defined. The power p35 may depend on a number of factors including, but not limited to, a form of the aerosol-generating element, a type of aerosol-forming substrate, an amount of aerosol desired to be formed, and a droplet size required for the aerosol. Preferably, after the initial burst of electric power, the power decreases, for example to the power p31.

The method according to the eleventh aspect may further comprise, after either the step of increasing the power supplied to the aerosol-generating element to the power p33 or the step of increasing the power supplied to the aerosol-generating element to the power p34, a step of decreasing the power supplied to the aerosol-generating element to a power p36 when the flow sensor detects that the flow rate of the air flow has decreased to less than an end of puff threshold t3*e*.

The power p36 may be zero. The end of puff threshold t3*e* may be an end of puff constant.

According to the eleventh aspect, supplying power to the aerosol-generating element may comprise supplying pulses of electric current to the aerosol-generating element.

According to a twelfth aspect, there is provided an aerosol-generating system arranged to perform the method according to the eleventh aspect. The system comprises an aerosol-generating element and a flow channel configured to allow an air flow past the aerosol-generating element. The system further comprises a flow sensor configured to detect the air flow, wherein the air flow is indicative of a user taking a puff, and a power supply for supplying power to the aerosol-generating element. The system further comprises electric circuitry for controlling supply of power from the power supply to the aerosol-generating element, the electric circuitry being arranged to perform a method according to the eleventh aspect.

According to a thirteenth aspect, there is provided electric circuitry for an aerosol-generating system, the electric circuitry being arranged to perform the method according to the eleventh aspect.

According to a fourteenth aspect, there is provided a computer program which, when run on programmable electric circuitry for an aerosol-generating system, causes the programmable electric circuitry to perform the method according to the eleventh aspect.

According to a fifteenth aspect, there is provided a computer readable storage medium having stored thereon a computer program which, when run on programmable electric circuitry for an aerosol-generating system, causes the programmable electric circuitry to perform the method according to the eleventh aspect.

According to a sixteenth aspect, there is provided a method of controlling aerosol production in an aerosol-generating system. The system comprises a data storage means and an aerosol-generating element. The system further comprises a housing having an air inlet and an air outlet, a flow channel being defined through the housing from the air inlet to the air outlet, the flow channel providing a flow of air past the aerosol-generating element when a user puffs on the system. The system further comprises a flow sensor configured to detect the air flow, wherein the air flow is indicative of a user taking a puff. The method comprises a step of increasing a power supplied to the aerosol-generating element from a power p4*x* to at least a power p41 when the flow sensor detects that a flow rate of the air flow is greater than a first threshold t41. The method further comprises a step of storing measurements taken by the flow sensor in the data storage means and a step of using measurements stored in the data storage means to intermittently calculate an estimate of a remaining volume of the puff. The method further comprises a step of decreasing the power supplied to the aerosol-generating element to a power p42 when the estimate of the remaining volume of the puff is less than a second threshold t42, the second threshold t42 being, or being indicative of, a measure of volume.

Advantageously, the method of the sixteenth aspect may allow an approximate volume, herein called a flushing volume, of air to flow through the aerosol-generating system after the power supplied to the aerosol-generating element is decreased. The second threshold t42 is, or is indicative of, the flushing volume.

According to the sixteenth aspect, the second threshold t42 may be a predetermined value.

According to the sixteenth aspect, the second threshold t42 may be, or may be indicative of, a volume approximately equal to an internal volume of a flow passage in a mouthpiece of the aerosol-generating system. That is, if the air flow flows through a flow passage in a mouthpiece of the aerosol-generating system, the flushing volume may advantageously be approximately equal to the volume of the flow passage in the mouthpiece. In this context, "approximately equal to the volume of the flow passage" may be used to mean within 1.5 and 0.5 times, or 0.75 and 1.25 times, or 0.9 and 1.1 times of the volume of the flow passage, or within 5 ml or 3 ml or 1 ml of the volume of the flow passage.

According to the sixteenth aspect, the second threshold t42 may be, or may be indicative of, a volume between 0.1 ml and 10 ml, or between 0.1 ml and 5 ml, or between 0.1 ml and 3 ml, or between 0.1 ml and 1 ml, or between 1 ml and 10 ml, or between 1 ml and 5 ml.

The method of the sixteenth aspect may comprise, after the step of decreasing the power supplied to the aerosol-generating element to a power p42 when the estimate of the remaining volume of the puff is less than a second threshold t42, a step of increasing the power supplied to the aerosol-generating element to a power p43. This step of increasing the power supplied to the aerosol-generating element to a power p43 may occur when the estimate of the remaining volume of the puff is greater than a third threshold t43, the third threshold t43 being greater than the second threshold t42.

According to the sixteenth aspect, the flow sensor may take measurements continuously or intermittently.

According to the sixteenth aspect, the intermittent calculations of estimates of the remaining volume of the puff may be calculated in one or more of a number of ways.

As a first example of how the calculations may be performed, the flow sensor may intermittently store volume flow rate values. In this context, "intermittently" may be used to mean regularly, for example every time period $T_P$. The time period $T_P$ may be, for example, 0.01 seconds. For the second and each subsequent stored value, a processor may calculate a current average rate of change of flow rate $A_c$. This current average rate of change of flow rate $A_c$ may be estimated by subtracting an immediately previous stored flow rate value $Q_{c-1}$ from a current flow rate value $Q_c$, and then dividing by the time period $T_P$. The processor may then assume that this current average rate of change of flow rate $A_c$ will remain constant. This means that a current remaining time $T_C$ of the puff may be estimated, when the current average rate of change of flow rate $A_c$ is negative, as equal to the negative of the current flow rate value $Q_c$ divided by the current average rate of change of flow rate $A_c$. The processor may calculate an estimate of the current remaining volume $V_c$ of the puff as −0.5 multiplied by the square of the current flow rate value $Q_c$ divided by the current average rate of change of flow rate $A_c$. Of course, this calculation only provides a reasonable estimate of the current remaining volume $V_c$, and the current remaining time $T_c$, of the puff when the current average rate of change of flow rate $A_c$ is negative, such that the estimate of the current remaining volume $V_c$ is positive. The processor may ignore all such estimates of the current remaining volume $V_c$ which return a negative value. The processor may not calculate the estimates until a negative current average rate of change of flow rate $A_c$ is calculated. Notably, the current remaining time $T_C$ does not need to be calculated to estimate the current remaining volume $V_c$. In the form of equations, the first example may be summarised as:

$$A_C = \frac{Q_C - Q_{C-1}}{T_P} \quad \text{Equation 1}$$

$$T_C = -\frac{Q_C}{A_C} \quad \text{Equation 2}$$

$$V_C = -\frac{Q_C^2}{2A_C} \quad \text{Equation 3}$$

Alternatively, as a second example, the current average rate of change of flow rate $A_c$ may be estimated by subtracting an immediately previous stored flow rate value $Q_{c-1}$ from an immediately subsequent flow rate value $Q_{c+1}$, and then dividing by the time period $T_p$. Of course, this estimation cannot be performed until the immediately subsequent flow rate value $Q_{c+1}$ has been measured. In the form of equations, the second example may be summarised as:

$$A_C = \frac{Q_{C+1} - Q_{C-1}}{T_P} \quad \text{Equation 4}$$

$$T_C = -\frac{Q_C}{A_C} \quad \text{Equation 5}$$

$$V_C = -\frac{Q_C^2}{2A_C} \quad \text{Equation 6}$$

Alternatively, as a third example, a non-linear extrapolation of the flow rate may be used. The non-linear extrapolation may use a predetermined polynomial. The non-linear extrapolation may use a predetermined polynomial which more accurately represents the change in flow rate of a puff towards the end of a common puff profile. Alternatively, the non-linear extrapolation may be dependent on previously stored measurements taken by the flow sensor during the current puff. For example, if the average rate of change of flow rate appears to be decreasing with each subsequent measurement taken near the end of the puff, then a polynomial may be chosen which more accurately estimates the changes in flow rate for such a puff, and a different polynomial may be chosen for puffs with constant or increasing rates of changes of flow rates. Advantageously, this may more accurately estimate the changes in flow rate towards the end of the puff and therefore provide a better estimate of the remaining volume of the puff.

According to the sixteenth aspect, the intermittent calculation of an estimate of a remaining volume of the puff may not begin until the flow sensor detects that the flow rate has decreased to less than an estimate starting threshold t4*s*. Alternatively, the intermittent calculation of an estimate of a remaining volume of the puff may not be acted upon, meaning that the power supplied to the aerosol-generating element may not be changed, until the flow sensor detects that the flow rate has decreased to less than an estimate starting threshold t4*s*. The estimate starting threshold t4*s* may be a predetermined proportion of a detected maximum flow rate. Advantageously, this may help to avoid changing the power supplied to the aerosol-generating element based on inaccurately small estimates of the remaining volume of the puff. For example, if the flow rate decreased dramatically after the detected maximum flow rate, then a calculated estimate for the remaining volume of the puff may be far smaller than the actual remaining volume of the puff.

According to the sixteenth aspect, any increase or decrease of power supplied to the aerosol-generating element may occur substantially instantly or gradually. As explained in relation to the claimed invention, and in reference to the method of the sixth aspect, the term "gradually" may be used to mean within a time period of between 0.1 seconds and 1 second, or between 0.2 seconds and 0.6 seconds, or between 0.2 seconds and 0.4 seconds, and the term "substantially instantly" may be used to mean within 0.1 seconds.

The method of the sixteenth aspect may comprise, after the step of increasing the power supplied to the aerosol-generating element from the power p4*x* to at least the power p41, but before the step of decreasing the power supplied to the aerosol-generating element to the power p42, a step of increasing the power supplied to the aerosol-generating element from at least the power p41 to the power p45.

According to the sixteenth aspect, the power supplied to the aerosol-generating element may be increased from at least the power p41 to the power p45 after, and preferably substantially instantly after, the step of increasing the power supplied to the aerosol-generating element from the power p4*x* to at least the power p41. In this context, the term "substantially instantly" may be used to mean within 0.1 seconds.

Alternatively, the step of increasing the power supplied to the aerosol-generating element from the power p4*x* to at least the power p41 may comprise increasing the power supplied to the aerosol-generating element from the power p4*x* to the power p45, where the power p45 is greater than the power p41.

This may provide a burst of electric power near the start of the puff. Such a burst of power near the start of the puff may result in adequate aerosol generation beginning earlier. This may provide better reactivity for the user. This may also decrease aerosol droplet size near the start of the puff. The power p45 may be pre-defined. The power p45 may depend on a number of factors including, but not limited to, a form of the aerosol-generating element, a type of aerosol-forming substrate, an amount of aerosol desired to be formed, and a droplet size required for the aerosol. Preferably, after the initial burst of electric power, the power decreases, for example to the power p41.

According to the sixteenth aspect, supplying power to the aerosol-generating element may comprise supplying pulses of electric current to the aerosol-generating element.

According to another aspect, there is provided an aerosol-generating system arranged to perform the method of the sixteenth aspect. The system comprises an aerosol-generating element and a flow channel configured to allow an air flow past the aerosol-generating element. The system further comprises a flow sensor configured to detect the air flow, wherein the air flow is indicative of a user taking a puff, and a power supply for supplying power to the aerosol-generating element. The system further comprises electric circuitry for controlling supply of power from the power supply to the aerosol-generating element, the electric circuitry being arranged to perform a method according to the sixteenth aspect.

According to another aspect, there is provided electric circuitry for an aerosol-generating system, the electric circuitry being arranged to perform the method of the sixteenth aspect.

According to another aspect, there is provided a computer program which, when run on programmable electric circuitry for an aerosol-generating system, causes the programmable electric circuitry to perform the method of the sixteenth aspect.

According to another aspect, there is provided a computer readable storage medium having stored thereon a computer program which, when run on programmable electric circuitry for an aerosol-generating system, causes the programmable electric circuitry to perform the method of the sixteenth aspect.

The aerosol-generating system may comprise an aerosol-forming substrate and the aerosol-generating element may comprise one or more elements configured to interact with the aerosol-forming substrate to generate an aerosol or vapour, for example by adding aerosol droplets to an air flow to generate an aerosol.

The aerosol-generating element may comprise a mechanical device, such as a vibrating orifice transducer or a piezoelectric device. The aerosol-generating element may comprise an electrical heater comprising at least one heater element. The at least one electric heating element may be arranged to heat an aerosol-forming substrate to form the aerosol.

The aerosol-generating element may comprise a single heating element. Alternatively, the aerosol-generating element may comprise more than one heating element, for example two, or three, or four, or five, or six or more heating elements. The heating element or heating elements may be arranged appropriately so as to most effectively heat the aerosol-forming substrate.

The aerosol-generating element may comprise at least one electric heating element. The at least one electric heating element preferably comprises an electrically resistive material. Suitable electrically resistive materials include, but are not limited to, semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, Constantan, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation, 1999 Broadway Suite 4300, Denver Colorado. In composite materials, the electrically resistive material may optionally be embedded in, encapsulated or coated with an insulating material or vice-versa, depending on the kinetics of energy transfer and the external physicochemical properties required. The heating element may comprise a metallic etched foil insulated between two layers of an inert material. In that case, the inert material may comprise Kapton®, all-polyimide or mica foil. Kapton® is a registered trade mark of E.I. du Pont de Nemours and Company, 1007 Market Street, Wilmington, Delaware 19898, United States of America.

Alternatively, or in addition, the aerosol-generating element may comprise an infra-red heating element, a photonic source, or an inductive heating element.

The at least one electric heating element may take any suitable form. For example, the at least one electric heating element may take the form of a heating blade.

The at least one electric heating element may comprise a casing or substrate having different electro-conductive portions, or an electrically resistive metallic tube. If the aerosol-forming substrate is a liquid provided within a container, the container may incorporate a disposable heating element.

The at least one electric heating element may comprise heating needles or rods that run through the centre of the aerosol-forming substrate.

The at least one electric heating element may comprise a disk (end) heater or a combination of a disk heater with heating needles or rods.

The at least one electric heating element may comprise a flexible sheet of material arranged to surround or partially surround the aerosol-forming substrate. Other alternatives include a heating wire or filament, for example a Ni—Cr, platinum, tungsten or alloy wire, or a heating plate. Optionally, the heating element may be deposited in or on a rigid carrier material.

Alternatively, or in addition, the aerosol-generating element may comprise a heating element, wherein the heating element comprises a plurality of electrically conductive filaments. The term "filament" may be used herein to refer to an electrical path arranged between two electrical contacts. A filament may arbitrarily branch off and diverge into several paths or filaments, respectively, or may converge from several electrical paths into one path. A filament may have a round, square, flat or any other form of cross-section. A filament may be arranged in a straight or curved manner.

The heating element may be an array of filaments, for example arranged parallel to each other. Preferably, the filaments may form a mesh. The mesh may be woven or non-woven. The mesh may be formed using different types of weave or lattice structures. Alternatively, the electrically conductive heating element consists of an array of filaments or a fabric of filaments. The mesh, array or fabric of electrically conductive filaments may also be characterized by its ability to retain liquid.

In a preferred embodiment, a substantially flat heating element may be constructed from a wire that is formed into a wire mesh. Preferably, the mesh has a plain weave design. Preferably, the heating element is a wire grill made from a mesh strip.

The filaments of the heating element may be formed from any material with suitable electrical properties. Suitable materials include, but are not limited to, semiconductors such as doped ceramics, electrically "conductive" ceramics, carbon, graphite, metals, metal alloys and composite materials made of a ceramic material and a metallic material.

Preferred materials for the electrically conductive filaments are stainless steel and graphite, more preferably 300 series stainless steel like AISI 304, 316, 304L, 316L. A combination of materials may be used for the electrically conductive heating element to improve the control of the resistance of the heating element. For example, materials with a high intrinsic resistance may be combined with materials with a low intrinsic resistance. This may be advantageous if one of the materials is more beneficial from other perspectives, for example price, machinability or other physical or chemical parameters. Advantageously, a substantially flat filament arrangement with increased resistance reduces parasitic losses. Advantageously, high resistivity heaters allow more efficient use of battery energy.

Preferably, the filaments are made of wire. Preferably, the wire is made of metal, most preferably stainless steel.

The electrically conductive filaments may define interstices between the filaments. The interstices may have a width of between 10 micrometres and 100 micrometres.

Preferably, the filaments give rise to capillary action in the interstices, so that in use, liquid to be vaporized is drawn into the interstices, increasing the contact area between the heating element and the liquid aerosol-forming substrate.

The at least one heating element may heat the aerosol-forming substrate by means of conduction. The heating element may be at least partially in contact with the substrate, or the carrier on which the substrate is deposited.

The heat from the heating element may be conducted to the substrate by means of a heat conductive element.

The at least one heating element may transfer heat to the incoming ambient air that is drawn through the electrically heated aerosol-generating system during use, which in turn heats the aerosol-forming substrate by convection. The ambient air may be heated before passing through the aerosol-forming substrate.

If the aerosol-forming substrate is a liquid substrate, the ambient air may be first drawn through the substrate and then heated.

The aerosol-forming substrate may be a solid aerosol-forming substrate. The aerosol-forming substrate preferably comprises a tobacco-containing material containing volatile tobacco flavour compounds which are released from the substrate upon heating. The aerosol-forming substrate may comprise a non-tobacco material. The aerosol-forming substrate may comprise tobacco-containing material and non-tobacco containing material. Preferably, the aerosol-forming substrate further comprises an aerosol former. Examples of suitable aerosol formers are glycerine and propylene glycol.

The aerosol-forming substrate may be a liquid aerosol-forming substrate. The aerosol-generating system may comprise a liquid storage portion. Preferably, the liquid aerosol-forming substrate is stored in the liquid storage portion. The aerosol-generating element may comprise a capillary wick in communication with the liquid storage portion. The aerosol-generating system may comprise a capillary wick for holding liquid without a liquid storage portion. In this case, the capillary wick may be preloaded with liquid.

Preferably, the capillary wick is arranged to be in contact with liquid in the liquid storage portion. In this case, in use, liquid is transferred from the liquid storage portion towards the at least one electric heating element by capillary action in the capillary wick. In one embodiment, the capillary wick has a first end and a second end, the first end extending into the liquid storage portion for contact with liquid therein and the at least one electric heating element being arranged to heat liquid in the second end. When the heating element is activated, the liquid at the second end of the capillary wick is vaporised by the heater to form the supersaturated vapour. The supersaturated vapour is mixed with and carried in the air flow. During the flow, the vapour condenses to form the aerosol and the aerosol is carried towards the mouth of a user. The heating element in combination with a capillary wick may provide a fast response, because this arrangement may provide a high surface area of liquid to the heating element. Control of the heating element according to the invention may therefore depend on the structure of the capillary wick arrangement.

The liquid substrate may be absorbed into a porous carrier material, which may be made from any suitable absorbent plug or body, for example, a foamed metal or plastics material, polypropylene, terylene, nylon fibres or ceramic. The liquid substrate may be retained in the porous carrier material prior to use of the electrically heated aerosol-generating system or alternatively, the liquid substrate material may be released into the porous carrier material during, or immediately prior to use. For example, the liquid substrate may be provided in a capsule. The shell of the capsule preferably melts upon heating and releases the liquid substrate into the porous carrier material. The capsule may optionally contain a solid in combination with the liquid.

If the aerosol-forming substrate is a liquid substrate, the liquid has physical properties, for example a boiling point suitable for use in the aerosol-generating. If the boiling point is too high, the at least one electric heating element will not be able to vaporise liquid in the capillary wick, but, if the boiling point is too low, the liquid may vaporise even without the at least one electric heating element being activated. Control of the at least one electric heating element may depend upon the physical properties of the liquid substrate. The liquid preferably comprises a tobacco-containing material comprising volatile tobacco flavour compounds which are released from the liquid upon heating. Alternatively, or in addition, the liquid may comprise a non-tobacco material. The liquid may include water, solvents, ethanol, plant extracts and natural or artificial flavours. Preferably, the liquid further comprises an aerosol former. Examples of suitable aerosol formers are glycerine and propylene glycol.

An advantage of providing a liquid storage portion is that a high level of hygiene can be maintained. Using a capillary wick extending between the liquid and the electric heating element, allows the structure of the system to be relatively simple. The liquid has physical properties, including viscosity and surface tension, which allow the liquid to be transported through the capillary wick by capillary action. The liquid storage portion is preferably a container. The liquid storage portion may not be refillable. Thus, when the liquid in the liquid storage portion has been used up, the aerosol-generating system is replaced. Alternatively, the liquid storage portion may be refillable. In that case, the aerosol-generating system may be replaced after a certain number of refills of the liquid storage portion. Preferably, the liquid storage portion is arranged to hold liquid for a pre-determined number of puffs.

The capillary wick may have a fibrous or spongy structure. The capillary wick preferably comprises a bundle of capillaries. For example, the capillary wick may comprise a plurality of fibres or threads, or other fine bore tubes. The fibres or threads may be generally aligned in the longitudinal direction of the aerosol-generating system.

Alternatively, the capillary wick may comprise sponge-like or foam-like material formed into a rod shape. The rod shape may extend along the longitudinal direction of the aerosol-generating system. The structure of the wick forms a plurality of small bores or tubes, through which the liquid can be transported to the electric heating element, by capillary action. The capillary wick may comprise any suitable material or combination of materials. Examples of suitable materials are ceramic- or graphite-based materials in the form of fibres or sintered powders. The capillary wick may have any suitable capillarity and porosity so as to be used with different liquid physical properties such as density, viscosity, surface tension and vapour pressure. The capillary properties of the wick, combined with the properties of the liquid, ensure that the wick is always wet in the heating area. If the wick is dry, there may be overheating, which can lead to thermal degradation of liquid.

During operation, the substrate may be completely contained within the aerosol-generating system. In that case, a user may puff on a mouthpiece of the electrically heated aerosol-generating system. Alternatively, during operation, the substrate may be partially contained within the aerosol-generating system. In that case, the substrate may form part of a separate article and the user may puff directly on the separate article.

Preferably, the aerosol-generating system is an electrically heated aerosol-generating system. Even more preferably, the aerosol-generating system is an electrically heated smoking system.

The aerosol-generating system comprises a flow channel, a portion of which may be termed an aerosol-forming chamber. In the aerosol-forming chamber, aerosol may form from a super saturated vapour and then be carried into the mouth of the user. The air inlet, air outlet and the chamber are preferably arranged so as to define an air flow route from the air inlet to the air outlet via the aerosol-forming chamber, so as to convey the aerosol to the air outlet and into the mouth of a user. Condensation may form on the walls of the aerosol-forming chamber. The amount of condensation may depend on the heating profile, particularly towards the end of the puff.

Preferably, the housing of the aerosol-generating system is elongate. The structure of the housing, including the surface area available for condensation to form, will affect the aerosol properties and whether there is liquid leakage from the aerosol-generating system. The housing may comprise a shell and a mouthpiece. In that case, all the components may be contained in either the shell or the mouthpiece. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle. The material of the housing may affect the amount of condensation forming on the housing which will, in turn, affect liquid leakage from the Preferably, the aerosol-generating system is portable. The aerosol-generating system may be a smoking system and may have a size comparable to a conventional cigar or cigarette. The smoking system may have a total length between approximately 30 mm and approximately 150 mm. The smoking system may have an external diameter between approximately 5 mm and approximately 30 mm.

Two or more of the methods described herein may be used in combination. For example, the end of puff threshold of the method of the first aspect may be calculated using the method according to the sixteenth aspect. That is, the end of puff threshold of the first aspect may be equal to the flushing volume of the sixteenth aspect.

Two or more of the methods described herein may be provided as different modes of operation in a single aerosol-generating system. A user may be able to choose which method is implemented using a user interface.

Features described in relation to one aspect described herein may be applicable to another aspect described herein. It will be clear to the skilled person where a feature described in relation to an aspect is applicable to another aspect.

The invention shall now be further described, by way of example only, with reference to the accompanying drawings, in which.

Figure 1:
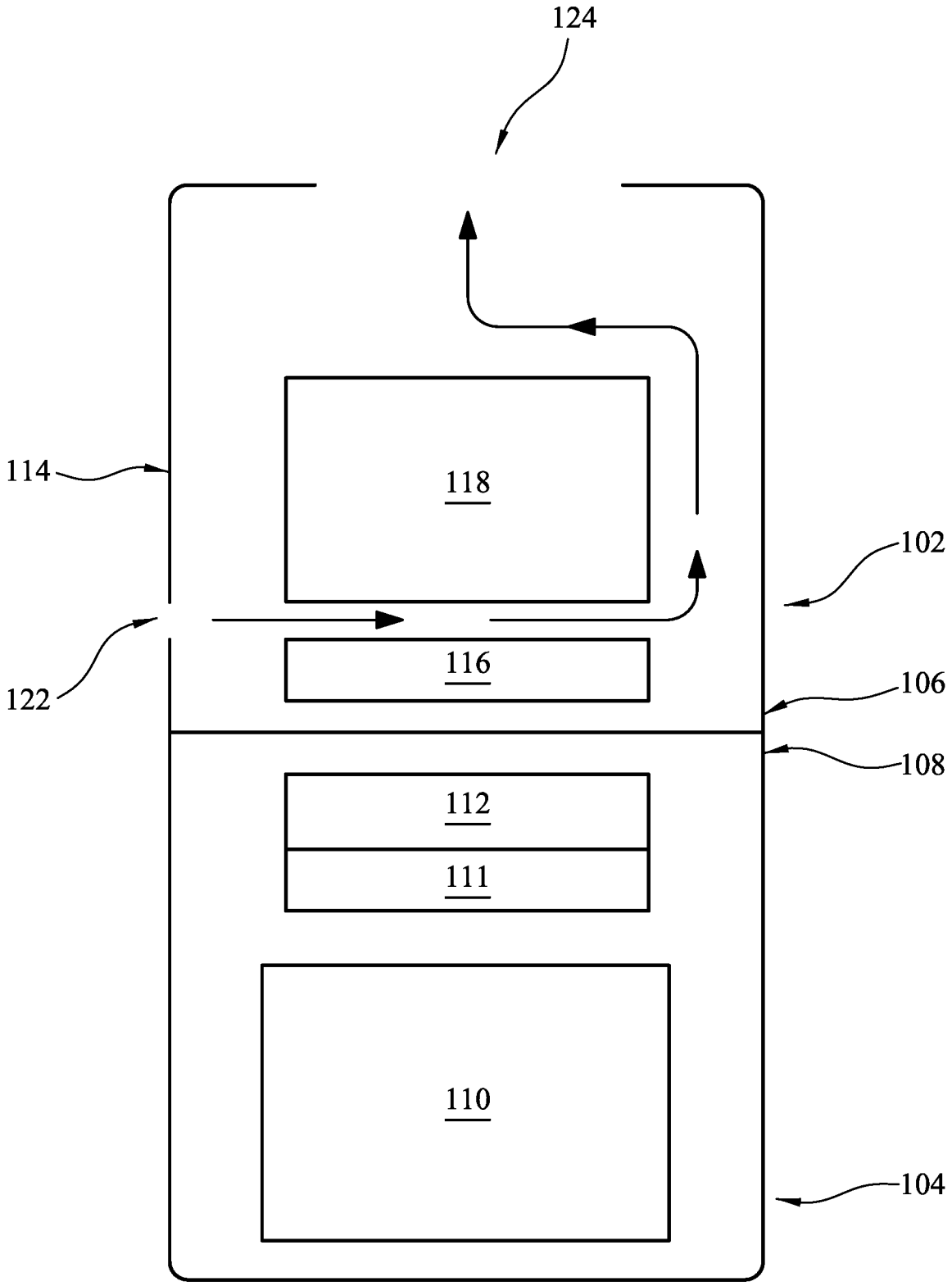
FIG. 1 is a schematic illustration of an aerosol-generating system.

FIG. 1 is a schematic illustration of an aerosol-generating system. The system 100 comprises two main components, a cartridge 102 and a control body 104. A connection end 106 of the cartridge 102 is removably connected to a corresponding connection end 108 of the control body 104. The aerosol-generating system 100 is portable and has a size comparable to a conventional cigar or cigarette.

The control body 104 contains a power supply 110, which in this example is a rechargeable lithium ion battery, and control circuitry 112. The control circuitry 112 includes a puff detection system 111.

The cartridge 102 comprises a housing 114 containing an atomising assembly 116 and a liquid storage compartment 118. The liquid storage compartment contains a capillary material that is soaked in a liquid aerosol-forming substrate. In this example the aerosol-forming substrate comprises 39% by weight glycerine, 39% by weight propylene glycol, 20% by weight water and flavourings, and 2% by weight nicotine. A capillary material is a material that actively conveys liquid from one end to another, and may be made from any suitable material. In this example the capillary material is formed from polyester.

In this embodiment, the atomising assembly comprises a plurality of electrically conductive heater filaments forming an electrically heated mesh heating element. When the cartridge 102 is connected to the control body 104, the power supply 110 is electrically connected to the mesh heating element. An air flow passage extends through the cartridge from an air inlet 122, past the atomising assembly 116, and to a mouth end opening 124 in the housing 114.

The system is configured so that a user can suck on the mouth end opening 124 of the cartridge 102 to draw aerosol into their mouth. In operation, when a user sucks on the mouth end opening 124, air is drawn through the airflow passage from the air inlet 122. The puff detection system 111 detects the air flow through the air flow passage and activates the atomising assembly 116. The control circuitry 112 controls the supply of electrical power from the power supply 110 to the atomising assembly 116. The air flows past the atomising assembly 116. The atomising assembly 116 generates a vapour that is entrained in the air flow passing through the air flow passage. The amount, and properties, of the vapour produced by the atomising assembly 116 are controlled, at least in part, by the power supplied to the atomising assembly 116 from the power supply 110. The air and entrained vapour, or aerosol, flows through the mouth end opening 124 and into the user's mouth.

FIG. 1 shows one example of an electrically heated aerosol-generating system which may be used with the invention. Many other examples are usable with the invention, however. The invention may be used with any electrically heated aerosol-generating system comprising an aerosol-generating element powered by a power supply under the control of electric circuitry. For example, the system need not be a smoking system. For example, the aerosol-forming substrate may be a solid substrate, rather than a liquid substrate. Alternatively, the aerosol-forming substrate may be another form of substrate such as a gel or paste. The aerosol-generating element may take any appropriate form. The overall shape and size of the housing could be altered and the housing could comprise a separable shell and mouthpiece. Other variations are, of course, possible.

In the embodiment of FIG. 1, the control circuitry 112 comprising the puff detection system 111 is programmable in order to control the supply of power to the mesh heating element. This, in turn, affects the heating profile which will affect the properties of the vapour, or aerosol. The term "heating profile" refers to a graphic representation of the power supplied to the heating element (or another similar measure, for example, the heat generated by the heating element) over the time taken for a puff. However, the aerosol-generating system would function in much the same way if the control circuitry 112 and the puff detection system 111 were hardwired to control the supply of power to the heating element. Again, this would affect the heating profile and, in turn, the droplet size in the aerosol.

Figure 2:
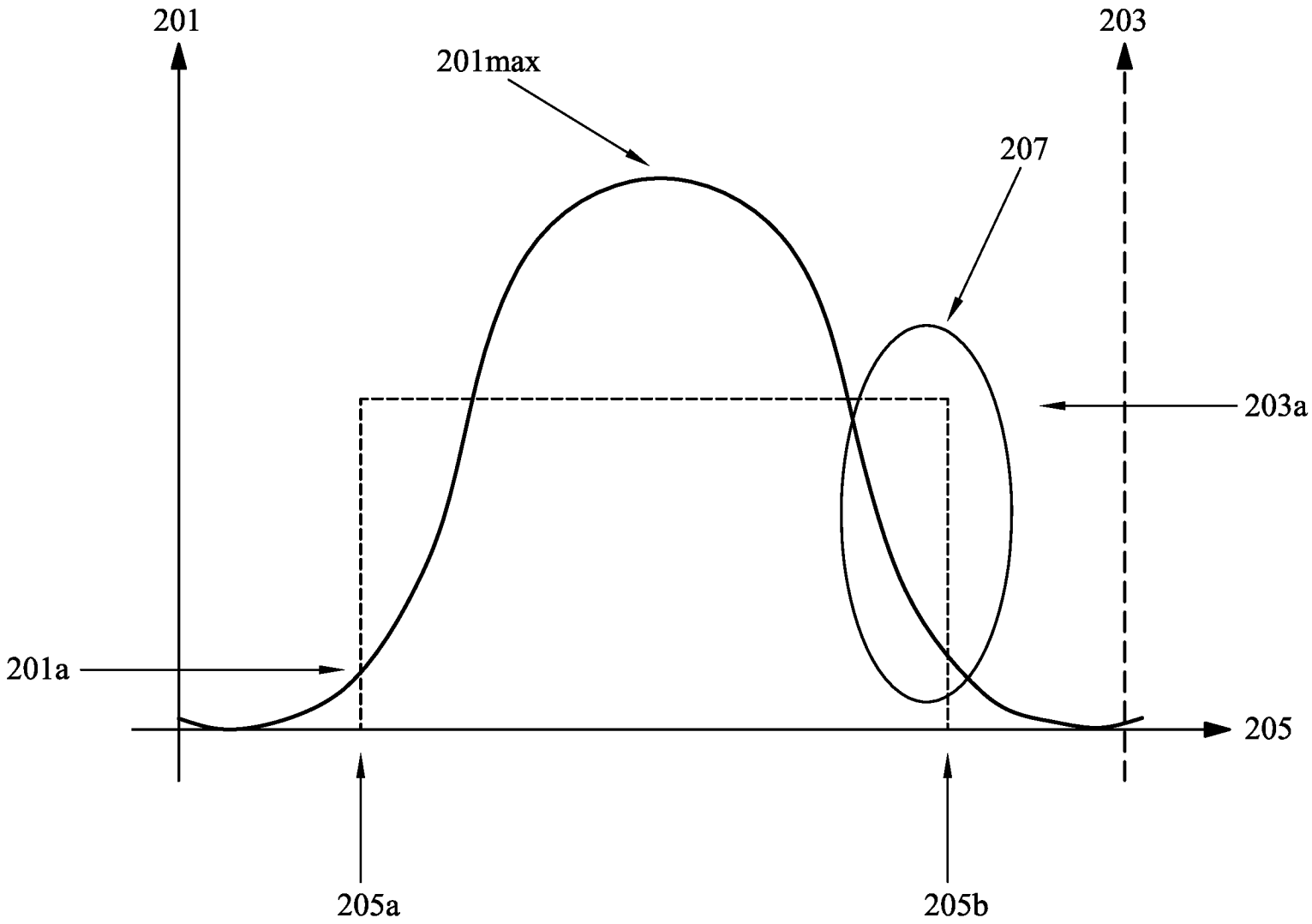
FIG. 2 is a plot showing air flow rate against time and a plot showing heating power against time in a known aerosol-generating system implementing a known method of controlling aerosol production.

FIG. 2 is a plot showing air flow rate against time and heating power against time in a known aerosol-generating system implementing a known method of controlling aerosol production.

FIG. 2 is a plot showing air flow rate 201 and heating power 203 on the vertical axes, and time 205 on the horizontal axis. Air flow rate 201 is shown by a solid line and heating power 203 is shown by a dotted line. The air flow rate is sensed by a puff detection system, such as puff detection system 111 in FIG. 1. The heating power, measured in Watts, is the power provided to the heating element from the power supply, under control of the electric circuitry such as control circuitry 112 in FIG. 1. FIG. 2 shows a single puff taken by a user on an electrically heated aerosol-generating system such as that shown in FIG. 1.

As can be seen in FIG. 2, in this embodiment, the air flow rate for the puff is illustrated as taking the shape of a normal or Gaussian distribution. The air flow rate begins at zero, increases gradually to a maximum 201max, then decreases back to zero. However, the air flow rate will typically not have an exact Gaussian distribution. In all cases, however, the air flow rate during a puff will increase from zero to a maximum, then decrease from the maximum to zero. The area under the air flow rate curve is the total air volume for that puff.

When the puff detection system senses that the air flow rate 201 has increased to a threshold 201*a*, at a time 205*a*, the electric circuitry controls the power to switch on the heating element and increase the heating power 203 directly from zero to power 203*a*. When the puff detection system senses that the air flow rate 201 has decreased back to threshold 201*a*, at a time 205*b*, the electric circuitry controls the power to switch off the heating element and decrease the heating power 203 directly from power 203*a* to zero. Between time 205*a* and time 205*b*, whilst the puff detection system detects that the air flow rate remains greater than threshold 201*a*, the heating power to the heating element is maintained at power 203*a*. Thus, the heating period is time 205*b*-205*a*.

In the embodiment of FIG. 2, the air flow rate threshold for switching on the heating element is the same as the air flow rate threshold for switching off the heating element. The advantage of the FIG. 2 arrangement is the simplicity of design. However, with this arrangement, there is a possibility of overheating towards the end of the puff, such as in the circled area 207 in FIG. 2. Further, there is a risk that if the flow rate of the puff were to increase again after the power supplied to the heater has been decreased to zero at time 205*b*, the user would be frustrated by the delivery of an inadequate aerosol after time 205*b* owing to the heater remaining without power.

Figure 3:
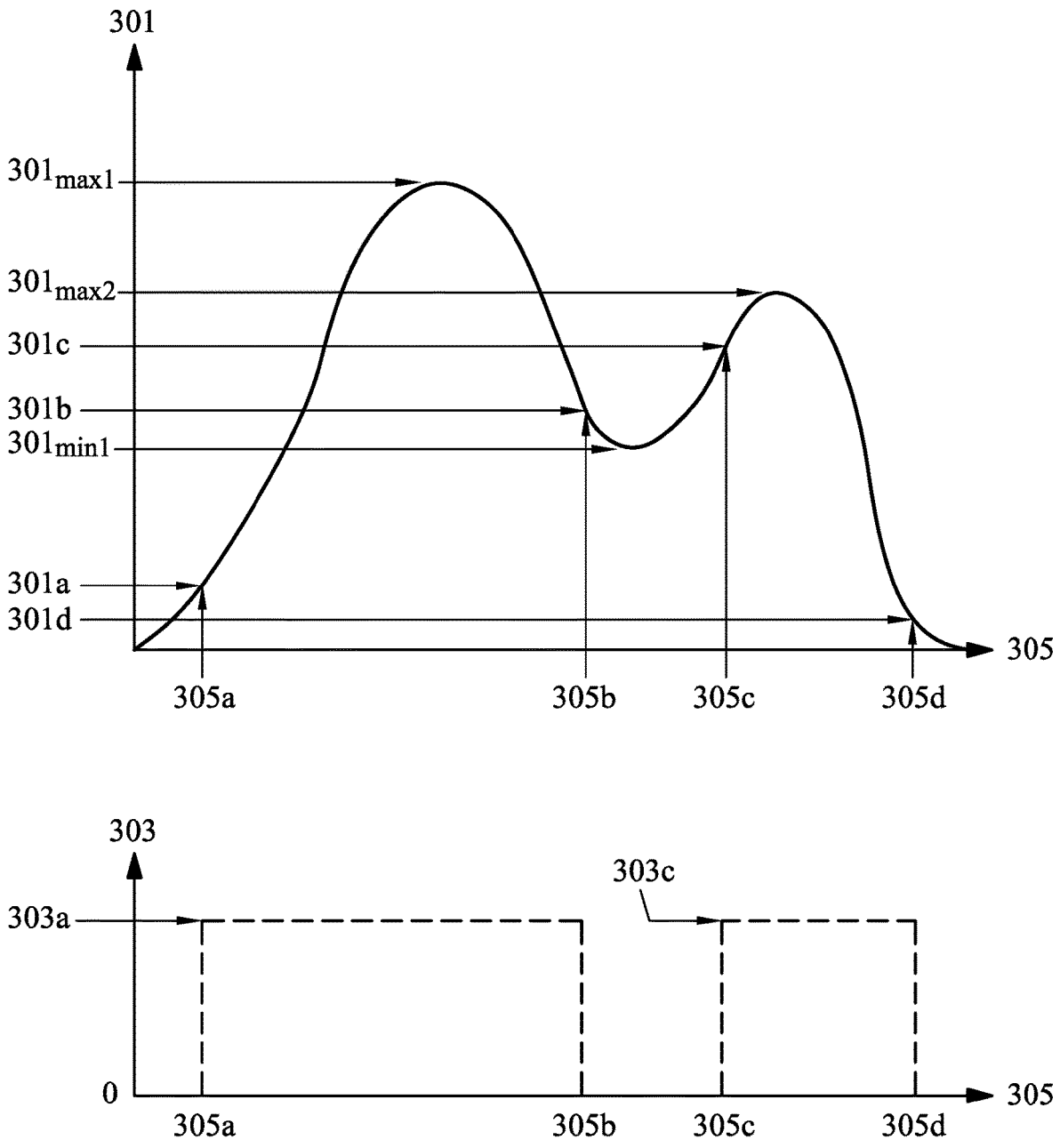
FIG. 3 is a plot showing air flow rate against time and a plot showing heating power against time in an aerosol-generating system according to the invention.

FIG. 3 contains two plots. One plot shows air flow rate 301 on the vertical axis and time 305 on the horizontal axis, and the other plot shows heating power 303 on the vertical axis and time 305 on the horizontal axis. The time 305 shown on both plots is the same time. That is, the plots of FIG. 3 show the air flow rate and heating power for the same puff. Air flow rate 301 is shown by a solid line and heating power 303 is shown by a dotted line. Air flow rate is measured in volume per unit of time, typically cubic centimetres per second. The air flow rate is sensed by a puff detection system, such as puff detection system 111 in FIG. 1. The heating power is the power provided to the heating element from the power supply, under control of the electric circuitry such as control circuitry 112 in FIG. 1. FIG. 3 shows a single puff taken by a user on an electrically heated aerosol-generating system, such as that shown in FIG. 1.

As can be seen in FIG. 3, in this embodiment, the puff profile is more complex than the puff profile shown in FIG. 2. In this embodiment, the air flow rate 301 rises from zero to a first maximum flow rate 301max1. The air flow rate then decreases to a flow rate 301min1 . The air flow rate then increases to a second maximum flow rate 301max2. The air flow rate then decreases to zero.

When the puff detection system senses that the air flow rate 301 has increased to a threshold 301*a*, at a time 305*a*, the electric circuitry controls the power to switch on the heating element and increase the heating power 303 substantially instantly from zero to power 303*a*.

When the puff detection system senses that the air flow rate 301 has decreased to a threshold 301*b*, at a time 305*b*, the electric circuitry controls the power to switch off the heating element and decrease the heating power 303 substantially instantly from power 303*a* to zero. Between time 305*a* and time 305*b*, the heating power to the heating element is maintained at power 303*a*.

When the puff detection system subsequently senses that the air flow rate 301 has increased to a threshold 301*c*, at a time 305*c*, the electric circuitry controls the power to switch on the heating element and increase the heating power 303 substantially instantly from zero to power 303*c*. When the puff detection system senses that the air flow rate 301 has decreased to a threshold 301*d*, at a time 305*d*, the electric circuitry controls the power to switch off the heating element and decrease the heating power 303 substantially instantly from power 303*c* to zero. Between time 305*c* and time 305*d*, the heating power to the heating element is maintained at power 303*c*.

In the embodiment of FIG. 3, threshold 301*a* is a predetermined constant and threshold 301*d* is another predetermined end of puff constant. Threshold 305*d* is less than threshold 301*a*. Threshold 301*b* is 50% of 301max1 and threshold 301*c* is 65% of 301max1. Power 303*a* and power 303*c* are equal.

Figure 4:
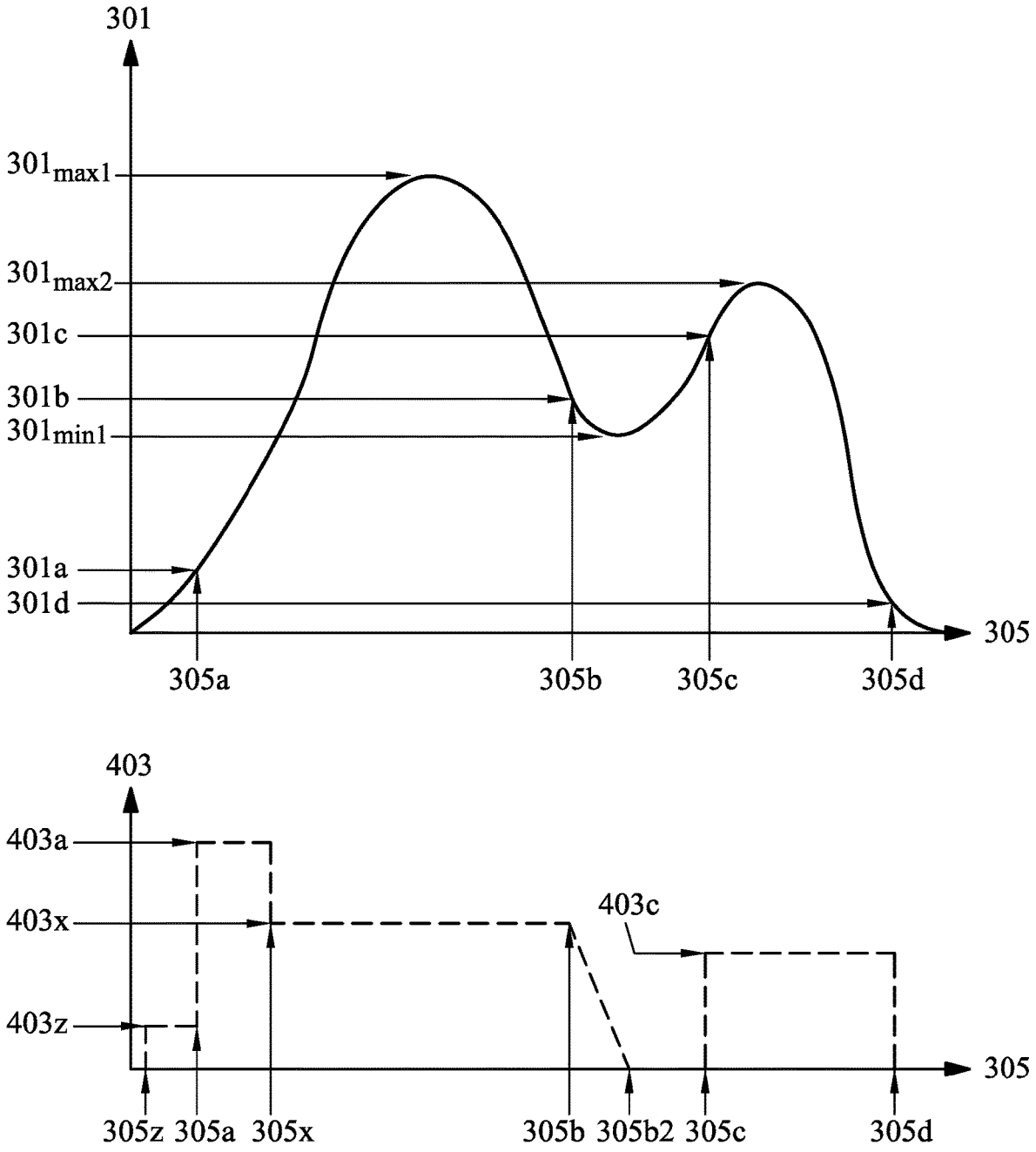
FIG. 4 is a plot showing air flow rate against time and a plot showing heating power against time in an aerosol-generating system according to the invention.

FIG. 4 contains two plots. The first plot of FIG. 4 shows the same puff profile as shown in FIG. 3. It is copied onto FIG. 4 only for comparison with the second plot of FIG. 4. The second plot shows heating power 403 on the vertical axis and time 405 on the horizontal axis. The times shown on both plots is the same time. That is, the plots of FIG. 4 show the air flow rate and heating power for the same puff. Air flow rate 301 is shown by a solid line and heating power 403 is shown by a dotted line. The air flow rate is sensed by a puff detection system, such as puff detection system 111 in FIG. 1. The heating power is the power provided to the heating element from the power supply, under control of the electric circuitry such as control circuitry 112 in FIG. 1. FIG. 4 shows a single puff taken by a user on an electrically heated aerosol-generating system, such as that shown in FIG. 1.

At time 305*z*, the user presses a button on the aerosol-generating system. In response, the electric circuitry controls the power to switch on the heating element and increase the heating power to the heating element to a power level 403*z*. As shown in FIG. 4, the user has pressed the button shortly after starting to puff on the system. However, the user could have pressed the button before starting to puff on the system and power would be supplied at power level 403*z* before any increase in air flow rate. In this embodiment, if the user were to press the button but the puff detection system did not detect an air flow rate above a threshold 301*a* within 10 seconds of the user pressing the button, then the power supplied to the heating element would be reduced back to zero.

When the puff detection system senses that the air flow rate 301 has increased to a threshold 301*a*, at a time 305*a*, the electric circuitry controls the power to the heating element to increase the heating power 403 directly from 403*z* to power 403*a*. The power supplied to the heating element is held at this power level for a short period of time relative to the average time of a puff, approximately 0.2 seconds, before reducing to a power level 403*x* at a time 305*x*. This provides an initial burst of power towards the start of the puff.

When the puff detection system senses that the air flow rate 301 has decreased to a threshold 301*b*, at a time 305*b*, the electric circuitry controls the power to switch off the heating element and decrease the heating power 403 from power 403*x* to zero. As shown in FIG. 4, this decrease in power occurs gradually, at a constant rate, between time 305*b* and 305*b*2.

When the puff detection system subsequently senses that the air flow rate 301 has increased to a threshold 301*c*, at a time 305*c*, the electric circuitry controls the power to switch on the heating element and increase the heating power 403 directly from zero to power 403*c*. When the puff detection system senses that the air flow rate 301 has decreased to a threshold 301*d*, at a time 305*d*, the electric circuitry controls the power to switch off the heating element and decrease the heating power 403 directly from power 403*c* to zero. Between time 305*c* and time 305*d*, the heating power to the heating element is maintained at power 403*c*.

In the embodiment of FIG. 4, threshold 301*a* is a predetermined constant and threshold 301*d* is another predetermined end of puff constant. Threshold 305*d* is less than threshold 301*a*. Threshold 301*b* is 50% of 301max1 and threshold 301*c* is 65% of 301max1. Power 403*a* is greater than power 403*x* which is greater than power 403*c* which is greater than power 403*z*.

Figure 5:
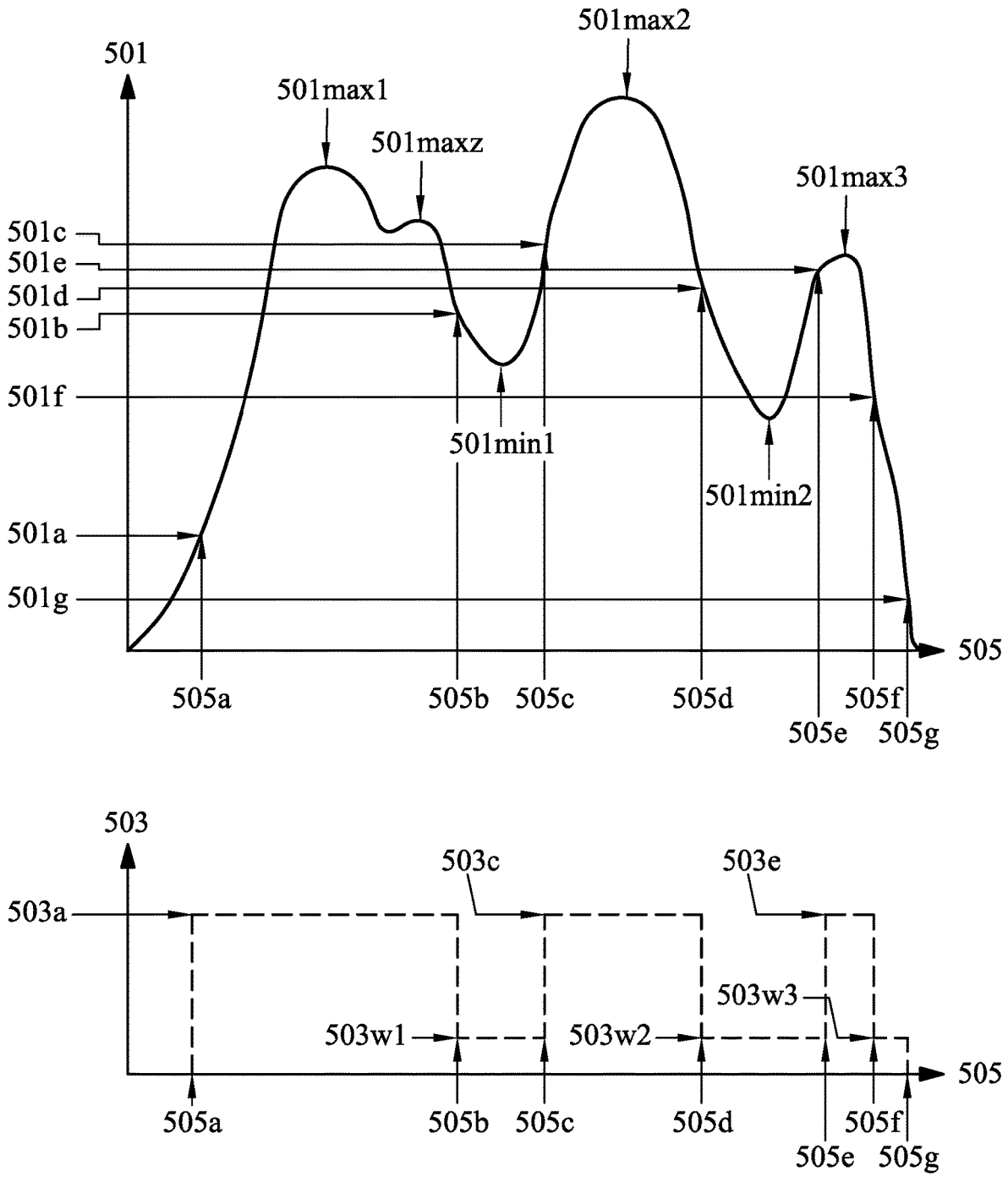
FIG. 5 is a plot showing air flow rate against time and a plot showing heating power against time in an aerosol-generating system according to the invention.

FIG. 5 contains two plots. One plot shows air flow rate 501 on the vertical axis and time 505 on the horizontal axis, and the other plot shows heating power 503 on the vertical axis and time 505 on the horizontal axis. The times 505 shown on both plots is the same time. That is, the plots of FIG. 5 show the air flow rate and heating power for the same puff. Air flow rate 501 is shown by a solid line and heating power 503 is shown by a dotted line. The air flow rate is sensed by a puff detection system, such as puff detection system 111 in FIG. 1. The heating power is the power provided to the heating element from the power supply, under control of the electric circuitry such as control circuitry 112 in FIG. 1. FIG. 5 shows a single puff taken by a user on an electrically heated aerosol-generating system, such as that shown in FIG. 1.

As can be seen in FIG. 5, in this embodiment, the puff profile is more complex than the puff profile shown in FIG. 3. In this embodiment, the air flow rate 501 rises from zero to a first maximum flow rate 501max1. The air flow rate then experiences another local maximum 501maxz before decreasing to a local minimum flow rate 501min1. The air flow rate then increases to another local maximum flow rate 501max2 before decreasing to another local minimum flow rate 501min2. The air flow rate then increases to another local maximum 501max3 before decreasing to zero. In FIG. 5, flow rate 501max2 is greater than 501max1 which is greater than 501maxz which is greater than 501max3 which is greater than 501min1 which is greater than 501min2.

When the puff detection system senses that the air flow rate 501 has increased to a threshold 501*a*, at a time 505*a*, the electric circuitry controls the power to switch on the heating element and increase the heating power 503 directly from zero to power 503*a*. When the puff detection system senses that the air flow rate 501 has decreased to a threshold 501*b*, at a time 505*b*, the electric circuitry controls the power to the heating element to decrease the heating power 503 directly from power 503*a* to 503*w*1. Between time 505*a* and time 505*b*, the heating power to the heating element is maintained at power 503*a*.

When the puff detection system subsequently senses that the air flow rate 501 has increased to a threshold 501*c*, at a time 505*c*, the electric circuitry controls the power to the heating element to increase the heating power 503 directly from 503*w*1 to power 503*c*. When the puff detection system senses that the air flow rate 501 has decreased to a threshold 501*d*, at a time 505*d*, the electric circuitry controls the power to the heating element to decrease the heating power 503 directly from power 503*c* to 503*w*2. Between time 505*c* and time 505*d*, the heating power to the heating element is maintained at power 503*c*.

When the puff detection system subsequently senses that the air flow rate 501 has increased to a threshold 501*e*, at a time 505*e*, the electric circuitry controls the power to the heating element to increase the heating power 503 directly from 503*w*2 to power 503*e*. When the puff detection system senses that the air flow rate 501 has decreased to a threshold 501*f*, at a time 505*f*, the electric circuitry controls the power to the heating element to decrease the heating power 503 directly from power 503*e* to 503*w*3. Between time 505*e* and time 505*f*, the heating power to the heating element is maintained at power 503*e*.

When the puff detection system senses that the air flow rate 501 has decreased to less than threshold 501*g*, the electric circuitry controls the power to the heating element to decrease the heating power 503 directly from power 503*w*3 to zero.

In the embodiment of FIG. 5, threshold 501*a* is a predetermined constant and threshold 501*g* is a predetermined end of puff constant. Threshold 501*g* is less than threshold 501*a*.

The local maximum flow rate 501maxz does not influence the threshold 501*b* because the local maximum flow rate 501maxz occurs between flow rate 501max1 and threshold 501*b* and the local maximum flow rate 501maxz is less than flow rate 501max1. If the flow rate 501maxz were greater than the flow rate 501max1, then the threshold 501*b* would be calculated as a proportion of the flow rate 501maxz.

The threshold 501*b* is 70% of 501max1. The threshold 501*c* is 80% of 501max1. The threshold 501*d* is 70% of 501max2. The threshold 501*e* is 80% of 501max2. Power 503*a*, power 503*c*, power 503*e*, power 503*w*1, power 503*w*2, and power 503*w*3 are predetermined powers where the largest of powers 503*w*1, 503*w*2 and 503*w*3 is less than the smallest of powers 503*a*, 503*c*, and 503*e*.

It should be noted that, according to the embodiment of FIG. 5, the power supplied to the heating element may be increased in response to the air flow rate increasing to greater than a threshold defined by a local maximum and decreased in response to an air flow rate decreasing to less than a threshold defined by a local maximum indefinitely. That is, whilst FIG. 5 shows three increases in the power supplied to the heating element, a different puff profile could show four, or five, or even more increases in the power supplied to the heating element.

Figure 6:
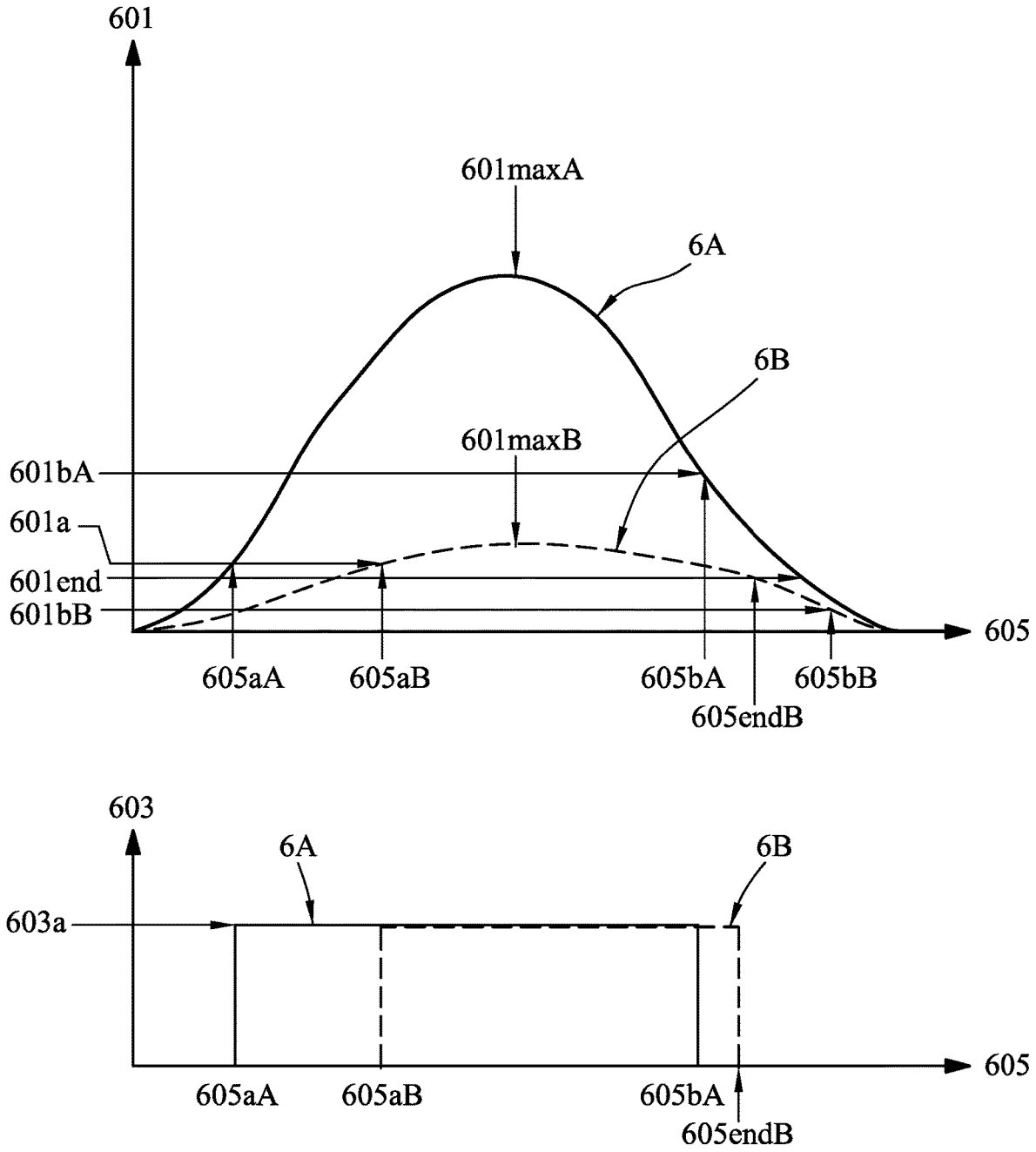
FIG. 6 is a plot showing air flow rate against time and a plot showing heating power against time in an aerosol-generating system according to the sixth aspect described herein.

FIG. 6 is a plot showing air flow rate against time and a plot showing heating power against time in an aerosol-generating system according to the sixth aspect described herein. FIG. 6 is a plot showing air flow rate 601 for a first puff 6A and for a second puff 6B on the vertical axis and time 605 on the horizontal axis, and a second plot showing heating power 603 for the first puff 6A and for the second puff 6B on the vertical axis and time 605 on the horizontal axis. The air flow rate 601 and heating power 603 for puff 6A is shown by a solid line and the air flow rate 601 and heating power 603 for puff 6B is shown by a dotted line. The air flow rate is sensed by a puff detection system, such as puff detection system 111 in FIG. 1. The heating power is the power provided to the heating element from the power supply, under control of the electric circuitry such as control circuitry 112 in FIG. 1. FIG. 6 shows a single puff taken by a user on an electrically heated aerosol-generating system, such as that shown in FIG. 1.

As can be seen in FIG. 6, in this embodiment, the air flow rates for the puffs are illustrated as taking the shape of normal or Gaussian distributions.

For puff 6A, the air flow rate begins at zero, increases gradually to a maximum 601maxA, then decreases gradually back to zero. For puff 6*b*, the air flow rate begins at zero, increases gradually to a maximum 601maxB, then decreases gradually back to zero.

The threshold 601*a* is a predetermined constant. The threshold 601end is also a predetermined end of puff constant. The threshold 601*b*A applies to puff A and not to puff B and is 50% of local maximum 601maxA. The threshold 601*b*B applies to puff B and not to puff A and is 50% of local maximum 601maxB.

For puff 6A, when the puff detection system senses that the air flow rate 601 has increased to a threshold 601*a*, at a time 605*a*A, the electric circuitry controls the power to switch on the heating element and increase the heating power 603 directly from zero to power 603*a*. It can be seen from FIG. 6 that threshold 601end is less than threshold 601*b*A and, for puff A, threshold 601*b*A is reached before threshold 601end. Thus, when the puff detection system senses that the air flow rate 601 has decreased to threshold 601*b*A, at a time 605*b*A, the electric circuitry controls the power to switch off the heating element and decrease the heating power 603 directly from power 603*a* to zero. Between time 605*a* and time 605*b*, the heating power to the heating element is maintained at power 603*a*.

For puff 6B, when the puff detection system senses that the air flow rate 601 has increased to a threshold 601*a*, at a time 605*a*B, the electric circuitry controls the power to switch on the heating element and increase the heating power 603 directly from zero to power 603*a*. It can be seen from FIG. 6 that, for puff B, threshold 601end is reached before threshold 601*b*B. Thus, when the puff detection system senses that the air flow rate 601 has decreased to threshold 601end, at a time 605endB, the electric circuitry controls the power to switch off the heating element and decreases the heating power 603 directly from power 603*a* to zero. The power supplied to the heating element is not changed when the air flow rate then decreases to threshold 601*b*B. Between time 605*a* and time 605*b*, the heating power to the heating element is maintained at power 603*a*.

Figure 7:
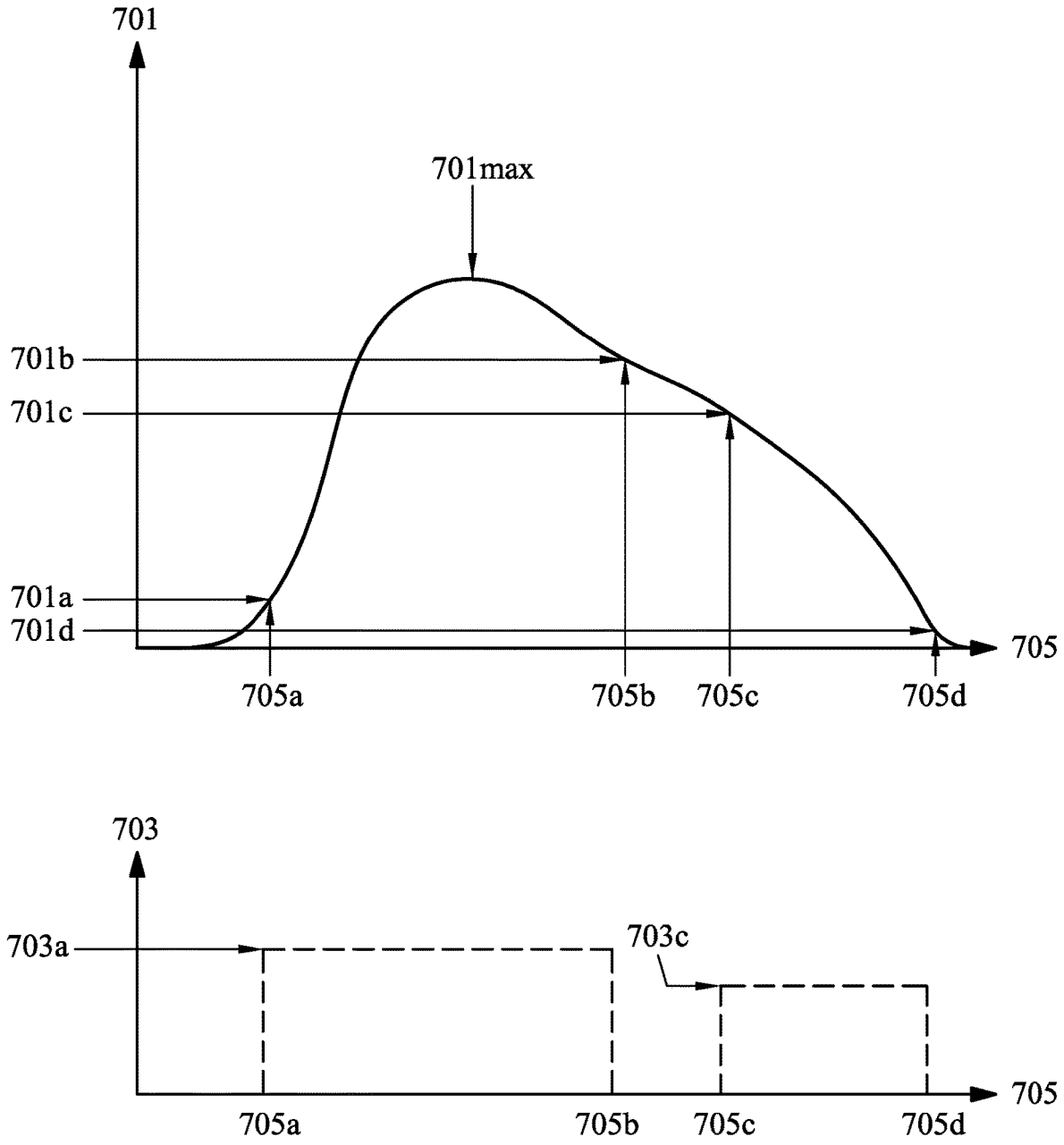
FIG. 7 is a plot showing air flow rate against time and a plot showing heating power against time in an aerosol-generating system according to the eleventh aspect described herein.

FIG. 7 is a plot showing air flow rate against time and a plot showing heating power against time in an aerosol-generating system according to the eleventh aspect described herein. The first plot of FIG. 7 shows air flow rate against time and the second plot of FIG. 7 shows heating power against time. Both plots relate to a single puff taken by a user on an electrically heated aerosol-generating system, such as that shown in FIG. 1.

The first plot shows air flow rate 701 on the vertical axis and time 705 on the horizontal axis, and the second plot shows heating power 703 on the vertical axis and time 705 on the horizontal axis. The time 705 shown on both plots is the same time. That is, the plots of FIG. 7 show the air flow rate and heating power for the same puff. Air flow rate 701 is shown by a solid line and heating power 703 is shown by a dotted line. The air flow rate is sensed by a puff detection system, such as puff detection system 111 in FIG. 1. The heating power is the power provided to the heating element from the power supply, under control of the electric circuitry such as control circuitry 112 in FIG. 1. FIG. 7 shows a single puff taken by a user on an electrically heated aerosol-generating system, such as that shown in FIG. 1.

The first plot of FIG. 7 shows a puff profile in which the air flow rate increases from zero to flow rate 701max and then decreases from 701max to zero. The plot exhibits a shape similar to a positively skewed, or right-skewed, normal distribution.

When the puff detection system senses that the air flow rate 701 has increased to a threshold 701*a*, at a time 705*a*, the electric circuitry controls the power to switch on the heating element and increase the heating power 703 directly from zero to power 703*a*. In this embodiment, the threshold 701*a* is a predetermined constant.

When the puff detection system senses that the air flow rate 701 has decreased to threshold 701*b*, at a time 705*b*, the electric circuitry controls the power to switch off the heating element and decrease the heating power 703 directly from power 703*a* to zero. In this embodiment, the threshold 701*b* is 70% of the flow rate 701max.

The puff detection system then waits from time 705*b*, for a fixed time period of 0.3 seconds, to time 705*c*. At time 705*c*, the puff detection system measures the flow rate as flow rate 701*c* and compares flow rate 701*c* with a restart threshold flow rate (not shown). In this embodiment, the restart threshold flow rate is 60% of flow rate 701max. If flow rate 705*c* is greater than the restart threshold flow rate, then the electric circuitry controls the power to switch on the heating element and increase the heating power. If flow rate 705*c* is less than than the restart threshold flow rate, then the heating element remains off until the end of the puff, or until there is another reason to switch the heating element back on. In the embodiment of FIG. 7, flow rate 705*c* is greater than the restart threshold flow rate, so the electric circuitry controls the power to switch on the heating element and increase the heating power 703 directly from zero to power 703*c*. In this embodiment, power 703*c* is less than power 703*a*.

The power to the heating element remains at power 703*c* until the puff detection system detects that the flow rate is less than flow rate threshold 701*d*, at which point the electric circuitry controls the power to switch off the heating element and decrease the heating power 703 directly from power 703*c* to zero.

In this embodiment, the puff detection system takes a flow rate measurement a given time after the flow rate threshold 701*b* is reached. This given time is equal time 705*c* minus time 705*b*. However, a similar or identical effect could be achieved in numerous alternative ways. Some of these alternatives can be explained with reference to FIG. 7.

In one exemplary alternative, the puff detection system could take regular flow rate measurements. The puff detection system could compare a measured flow rate 701*c* with the restart threshold, where flow rate 701*c* is measured a given number of flow rate measurements after the first measurement taken subsequent to the flow rate decreasing to less than the threshold 701*b*. Then, similarly to the method implemented in the embodiment of FIG. 7, if flow rate 705*c* is greater than the restart threshold flow rate, then the electric circuitry controls the power to switch on the heating element and increase the heating power, but if flow rate 705*c* is less than the restart threshold flow rate, then the heating element remains off until the end of the puff, or until there is another reason to switch the heating element back on.

In a second exemplary alternative, the puff detection system could continuously or intermittently measure the flow rate. When the puff detection system detects that the flow rate is less than the threshold 701*c*, the aerosol-generating system may compare an approximate time difference with a restart time threshold, where the approximate time difference is approximately the time between detecting that the flow rate is less than the threshold 701*b* and detecting that the flow rate is less than the threshold 701*c*, and where the threshold 701*b* is greater than threshold 701*c*. Then, if the approximate time difference is greater than the restart time threshold, the electric circuitry controls the power to switch on the heating element and increase the heating power, or, if the approximate time difference is less than the restart time threshold, the heating element remains off until the end of the puff, or until there is another reason to switch the heating element back on.

Figure 8:
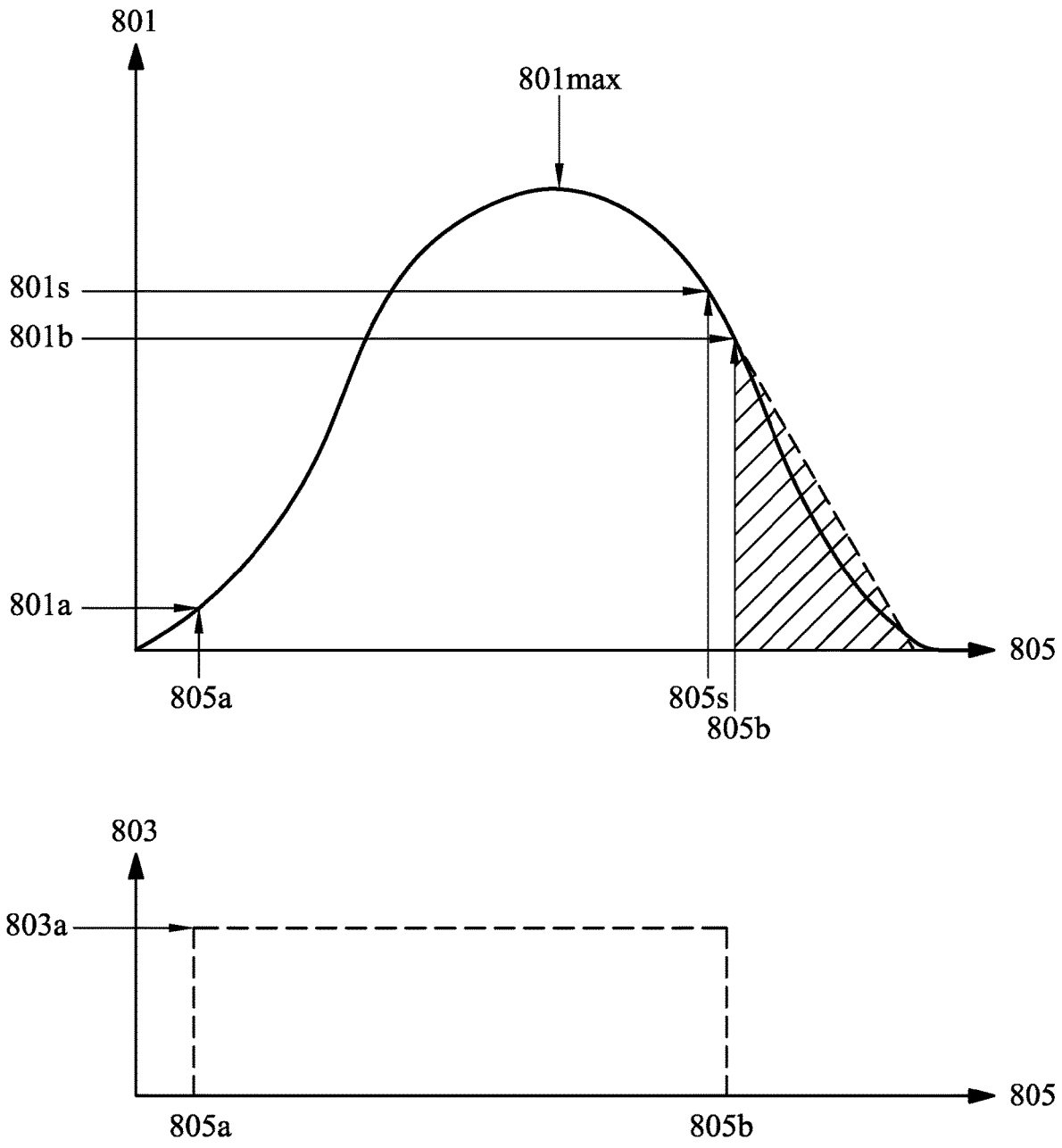
FIG. 8 is a plot showing air flow rate against time and a plot showing heating power against time in an aerosol-generating system according to the sixteenth aspect described herein.

FIG. 8 is a plot showing air flow rate against time and a plot showing heating power against time in an aerosol-generating system according to the sixteenth aspect described herein. FIG. 8 is a plot showing air flow rate 801 on the vertical axis and time 805 on the horizontal axis, and a second plot showing heating power 803 on the vertical axis and time 805 on the horizontal axis. Air flow rate 801 is shown by a solid line and heating power 803 is shown by a dotted line. The air flow rate is sensed by a puff detection system, such as puff detection system 111 in FIG. 1. The heating power is the power provided to the heating element from the power supply, under control of the electric circuitry such as control circuitry 112 in FIG. 1. FIG. 8 shows a single puff taken by a user on an electrically heated aerosol-generating system, such as that shown in FIG. 1. In this embodiment, the control circuitry 112 shown in FIG. 1 must comprise a data storage means capable of storing measurements taken by the puff detection system 111.

As can be seen in FIG. 8, in this embodiment, the air flow rate for the puff is illustrated as taking the shape similar to a normal or Gaussian distribution. The air flow rate begins at zero, increases gradually to a maximum 801max, then decreases back to zero.

In this embodiment, the aerosol-generating system intermittently stores measurements taken by the puff detection system in a data storage means.

When the puff detection system senses that the air flow rate 801 has increased to a threshold 801*a*, at a time 805*a*, the electric circuitry controls the power to switch on the heating element and increase the heating power 803 directly from zero to power 803*a*.

When the puff detection system senses that the air flow rate 801 has decreased to a threshold 801*s*, at a time 805*s*, the aerosol-generating system starts intermittently calculating an estimate for the remaining volume of the puff based on a current detected flow rate and an estimate of a current rate of change of flow rate. In this embodiment, flow rate threshold 801*s* is 80% of maximum detected flow rate 801max.

In this embodiment, the flow sensor intermittently stores volume flow rate values. In this context, "intermittently" is used to mean regularly, every time period $T_P$, though the system would function similarly if the values were not stored regularly. Time period $T_P$ is small relative to the time duration of an average puff. In this embodiment, the time period $T_P$ is 0.01 seconds. After threshold 801*s* is reached, a processor of the aerosol-generating system calculates a current average rate of change of flow rate $A_c$. This current average rate of change of flow rate $A_c$ is calculated by subtracting a flow rate value $Q_{c-5}$, which was stored five flow rate values before the current flow rate value, from a current flow rate value $Q_c$, and then dividing by five, and then dividing by the time period $T_P$. The processor then assumes that this current average rate of change of flow rate $A_c$ will remain constant. This means that a current remaining time $T_C$ of the puff may be estimated, when the current average rate of change of flow rate $A_c$ is negative, as equal to the negative of the current flow rate value $Q_c$ divided by the current average rate of change of flow rate $A_c$. The processor then calculates an estimate of the current remaining volume $V_c$ of the puff as −0.5 multiplied by the square of the current flow rate value divided by the current average rate of change of flow rate. The processor compares each calculated estimate of the current remaining volume $V_c$ of the puff with a threshold volume. In this embodiment, the threshold volume is 3 ml.

In the first plot of FIG. 8, at time 805*b*, the flow rate 801*b* is measured and stored in the data storage means. The estimate for the remaining volume of the puff is then calculated. This estimate for the remaining volume of the puff is shown as the shaded volume in the first plot of FIG. 8. In the embodiment of FIG. 8, this estimate for the remaining volume of the puff is the first estimate which is less than 3 ml. Thus, the electric circuitry controls the power to switch off the heating element and decrease the heating power 803 directly from power 803*a* to zero.

The figures show particular embodiments of the aspects described herein. However, it should be clear that changes may be made to the described embodiments within the scope of the invention. It would be clear to the skilled person that, where appropriate, features described in relation to one aspect or embodiment may be applied to one or more of the other aspects or embodiments.

Advantageously, all of the embodiments described herein provide an improved method of controlling aerosol production in an aerosol-generating system. In particular, the claimed invention provides an improved method of controlling aerosol production during a complex puff profile.

The invention claimed is:

1. A method of controlling aerosol production in an aerosol-generating system, the aerosol-generating system comprising:

an aerosol-generating element, a housing having an air inlet and an air outlet, a flow channel being defined through the housing from the air inlet to the air outlet, the flow channel being configured to provide a flow of air past the aerosol-generating element when a user puffs on the system, and a flow sensor configured to detect an air flow in the flow channel indicative of the user taking a puff; and the method comprising the following chronological steps:

increasing a power supplied to the aerosol-generating element from a power P0 to at least a power P1 when the flow sensor detects that a flow rate of the air flow is greater than a first threshold, decreasing the power supplied to the aerosol-generating element to a power P2, which is less than the power P1, when the flow sensor detects that the flow rate of the air flow is less than a second threshold, the second threshold being, or being indicative of, a flow rate that is a predetermined first proportion of a first maximum flow rate sensed by the flow sensor, and increasing the power supplied to the aerosol-generating element if the flow sensor detects that the flow rate of the air flow is greater than a third threshold, which is greater than the second threshold, before detecting that the flow rate of the air flow is less than an end of puff threshold, the end of puff threshold being less than the second threshold.

2. The method according to claim 1, wherein the power P0 is zero, or the power P2 is zero, or both the power P0 is zero and the power P2 is zero.

3. The method according to claim 1, wherein the third threshold is a predetermined second proportion of the first maximum flow rate, the predetermined second proportion being greater than the predetermined first proportion, or the third threshold is a predetermined multiple of the second threshold, the predetermined multiple being greater than 1.

4. The method according to claim 1, wherein the first threshold is a first constant, or the end of puff threshold is an end of puff constant, or the first threshold is a first constant and the end of puff threshold is an end of puff constant.

5. The method according to claim 1, wherein the step of increasing the power supplied to the aerosol-generating element from the power P0 to at least a power P1 comprises increasing the power supplied to the aerosol-generating element to a power PX, PX being greater than or equal to the power P1, and wherein the step of increasing the power supplied to the aerosol-generating element if the flow sensor detects that the flow rate of the air flow is greater than the third threshold before detecting that the flow rate of the air flow is less than the end of puff threshold comprises increasing the power supplied to the aerosol-generating element to a power P3, P3 being less than or equal to PX.

6. The method according to claim 1, the method further comprising, after the step of increasing the power supplied to the aerosol-generating element if the flow sensor detects that the flow rate of the air flow is greater than the third threshold before detecting that the flow rate of the air flow is less than the end of puff threshold, a step of decreasing the power supplied to the aerosol-generating element to a power P4 when the flow sensor detects that the flow rate of the air flow is less than the end of puff threshold.

7. The method according to claim 6, wherein the power P4 is zero.

8. The method according to claim 1, wherein:

the step of increasing the power supplied to the aerosol-generating element from the power P0 to at least the power P1 comprises increasing the power from the power P0 to at least the power P1 substantially instantly, or the step of decreasing the power supplied to the aerosol-generating element to the power P2 comprises decreasing the power supplied to the aerosol-generating element to the power P2 substantially instantly, or both the step of increasing the power supplied to the aerosol-generating element from the power P0 to at least the power P1 comprises increasing the power from the power P0 to at least the power P1 substantially instantly and the step of decreasing the power supplied to the aerosol-generating element to the power P2 comprises decreasing the power supplied to the aerosol-generating element to the power P2 substantially instantly.

9. The method according to claim 1, wherein:

the step of increasing the power supplied to the aerosol-generating element from the power P0 to at least the power P1 comprises increasing the power from the power P0 to at least the power P1 gradually, or the step of decreasing the power supplied to the aerosol-generating element to a power P2 comprises decreasing the power supplied to the aerosol-generating element to the power P2 gradually, or both the step of increasing the power supplied to the aerosol-generating element from the power P0 to at least the power P1 comprises increasing the power from the power P0 to at least the power P1 gradually and the step of decreasing the power supplied to the aerosol-generating element to a power P2 comprises decreasing the power supplied to the aerosol-generating element to the power P2 gradually.

10. The method according to claim 1, the method further comprising, after the step of increasing the power supplied to the aerosol-generating element from the power PO to at least the power P1, but before the step of decreasing the power supplied to the aerosol-generating element to the power P2, a step of:

increasing the power supplied to the aerosol-generating element from at least the power P1 to a power P5.

11. The method according to claim 1, wherein supplying power to the aerosol-generating element comprises supplying pulses of electric current to the aerosol-generating element.

12. An aerosol-generating system, comprising:

an aerosol-generating element;

a flow channel configured to allow an air flow past the aerosol-generating element;

a flow sensor configured to detect the air flow, wherein the air flow is indicative of a user taking a puff;

a power supply configured to supply power to the aerosol-generating element; and electric circuitry configured to control a supply of power from the power supply to the aerosol-generating element, the electric circuitry being configured to perform the method according to claim 1.

13. Electric circuitry for an aerosol-generating system, the electric circuitry being configured to perform the method of claim 1.

14. A nontransitory computer-readable storage medium having a computer program stored thereon that when executed on programmable electric circuitry for an aerosol-generating system causes the programmable electric circuitry to perform the method according to claim 1.

* * * * *